US011786937B2

(12) United States Patent
Lambert et al.

(10) Patent No.: US 11,786,937 B2
(45) Date of Patent: Oct. 17, 2023

(54) AGGREGATE PROCESSING SYSTEMS, METHODS AND APPARATUS

(71) Applicant: Superior Industries, Inc., Morris, MN (US)

(72) Inventors: Doug Lambert, Maryville, TN (US); Mark Crooks, Chapel Hill, NC (US); Lafe Grimm, Morris, MN (US); Matt Gordon, Northglenn, CO (US)

(73) Assignee: Superior Industries, Inc., Morris, MN (US)

( * ) Notice: Subject to any disclaimer, the term of this patent is extended or adjusted under 35 U.S.C. 154(b) by 0 days.

(21) Appl. No.: 17/271,855

(22) PCT Filed: Aug. 28, 2019

(86) PCT No.: PCT/US2019/048614

§ 371 (c)(1),
(2) Date: Feb. 26, 2021

(87) PCT Pub. No.: WO2020/047131

PCT Pub. Date: Mar. 5, 2020

(65) Prior Publication Data

US 2021/0197230 A1 Jul. 1, 2021

Related U.S. Application Data

(60) Provisional application No. 62/870,339, filed on Jul. 3, 2019, provisional application No. 62/733,257, filed on Sep. 19, 2018, provisional application No. 62/724,011, filed on Aug. 28, 2018.

(51) Int. Cl.
*B07B 1/46* (2006.01)
*B07B 13/16* (2006.01)

(52) U.S. Cl.
CPC ..... *B07B 1/46* (2013.01); *B07B 13/16* (2013.01)

(58) Field of Classification Search
CPC ..... B07B 1/16
USPC ..... 209/363, 364, 373
See application file for complete search history.

(56) References Cited

U.S. PATENT DOCUMENTS

| | | | | |
|---|---|---|---|---|
| 4,105,544 | A * | 8/1978 | Stevick | B07B 11/06 209/257 |
| 6,602,130 | B1 * | 8/2003 | Manning | B07B 13/16 460/100 |
| 8,783,438 | B2 * | 7/2014 | Phan | A47F 9/04 198/367 |
| 2002/0121463 | A1 * | 9/2002 | Egge | B03B 5/40 209/172.5 |
| 2016/0228919 | A1 * | 8/2016 | Vallelly | B07B 9/02 |

* cited by examiner

*Primary Examiner* — Michael McCullough
*Assistant Examiner* — Molly K Devine
(74) *Attorney, Agent, or Firm* — Todd R. Fronek; Larkin Hoffman Daly & Lindgren, Ltd.

(57) ABSTRACT

Aggregate processing systems, methods, and apparatus are described. In some embodiments, a plant is configurable in one of a plurality of configurations, e.g. by sliding one of a plurality of chutes, hoppers, or flumes into a frame and/or by modifying a height of the frame. In some embodiments, a roller floor assembly is in a maintenance configuration when a chute is in a maintenance position. In some embodiments, a flume includes one or more diverters for moving a subset of material from one side of the flume to another.

18 Claims, 26 Drawing Sheets

SECTION A-A

DETAIL B

AGGREGATE PROCESSING SYSTEMS, METHODS AND APPARATUS

BACKGROUND

Aggregate processing plants such as washing and/or classifying plants and related equipment are used to remove fine material and/or contaminants from and/or to classify aggregate materials.

DESCRIPTION

Figure 1:
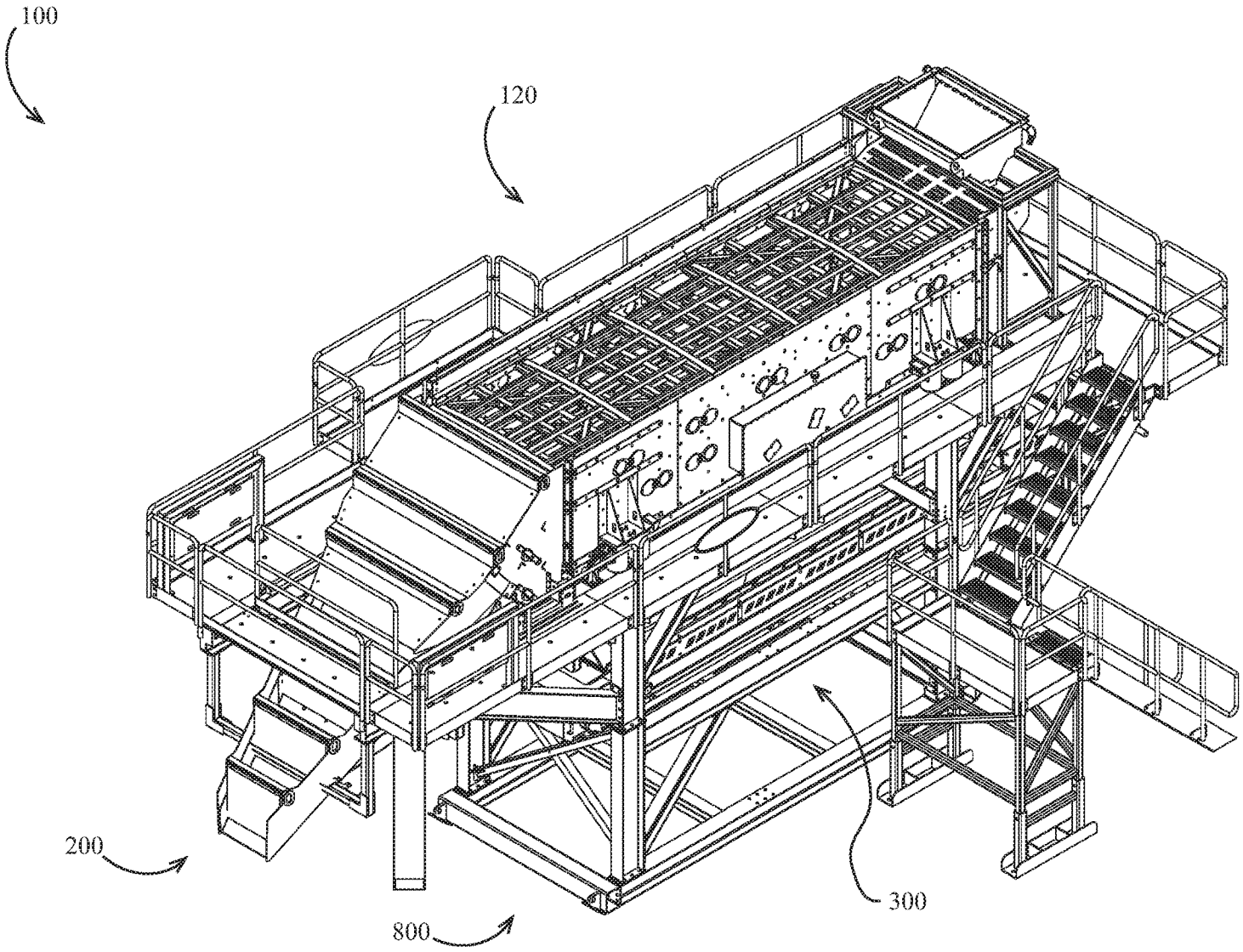
FIG. 1 is a perspective view of an embodiment of an aggregate processing plant in a dry processing configuration.
Figure 2:
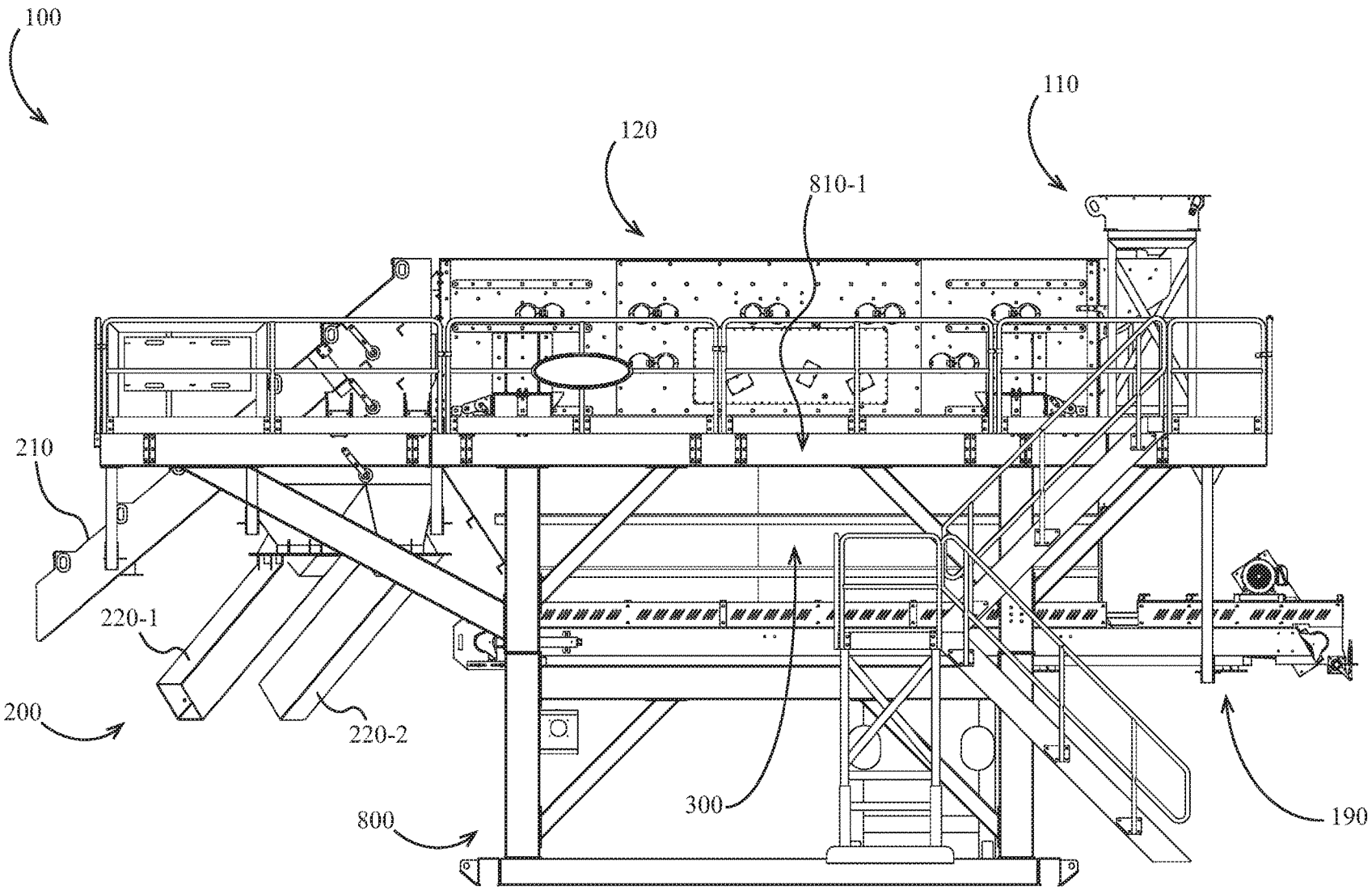
FIG. 2 is a side elevation view of the aggregate processing plant of FIG. 1.
Figure 3:
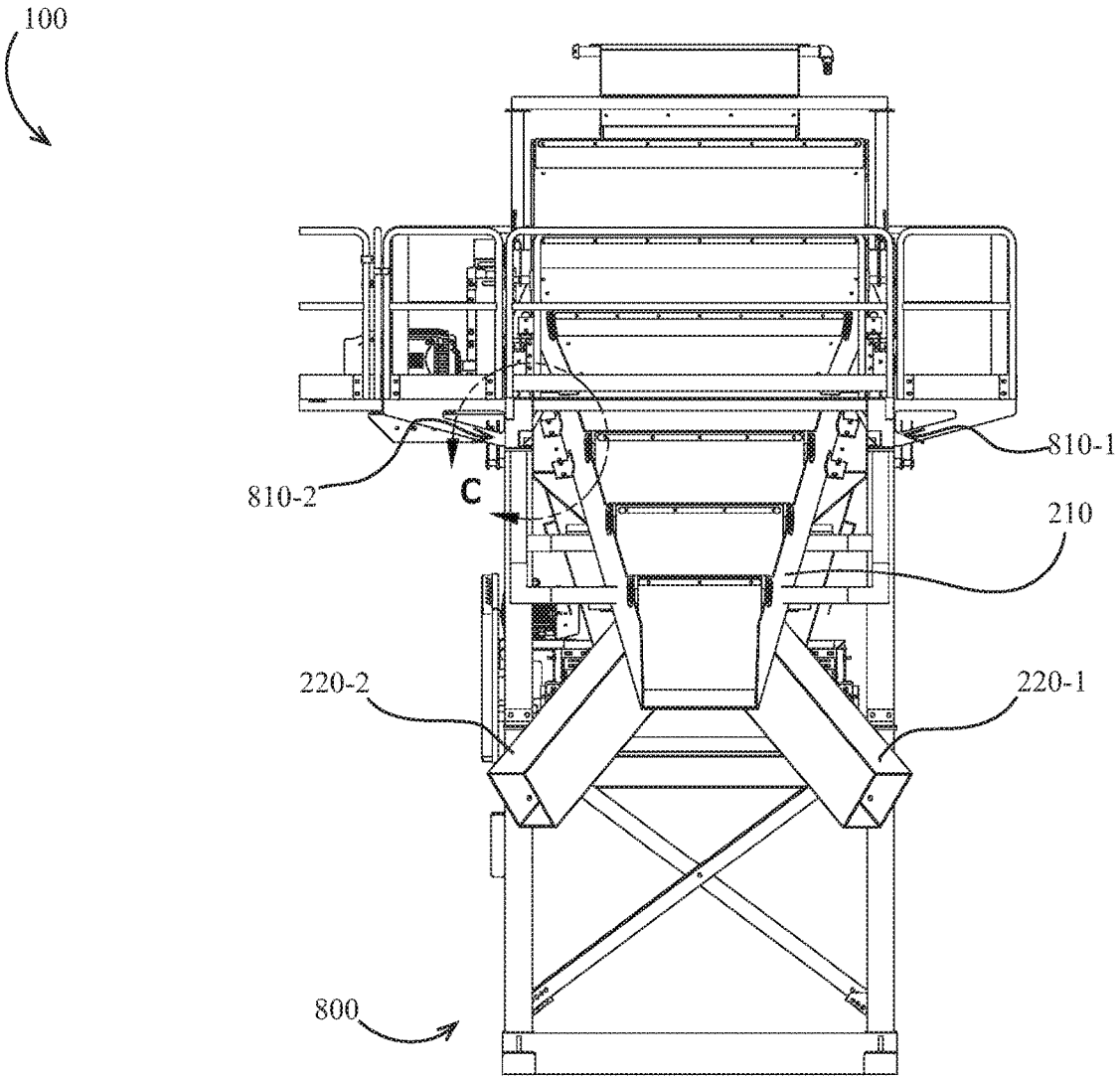
FIG. 3 is a front elevation view of the aggregate processing plant of FIG. 1.

Referring to the drawings, wherein like reference numerals designate identical or corresponding parts throughout the several views, FIGS. 1-6 illustrate an embodiment of an aggregate processing plant 100 including a screen 120 supported on a frame 800. A feeder or hopper 110 is optionally provided on the screen 120 for receiving aggregate material and depositing aggregate material onto one or more decks of the screen 120. In some embodiments, a dry hopper 300 is disposed below the screen 120 and is optionally removable from the frame 800, e.g., by sliding the dry hopper 300 out (e.g., to the left or right on the view of FIG. 2) from the frame 800 via one or more slots 812 in the frame 800.

Figure 4:
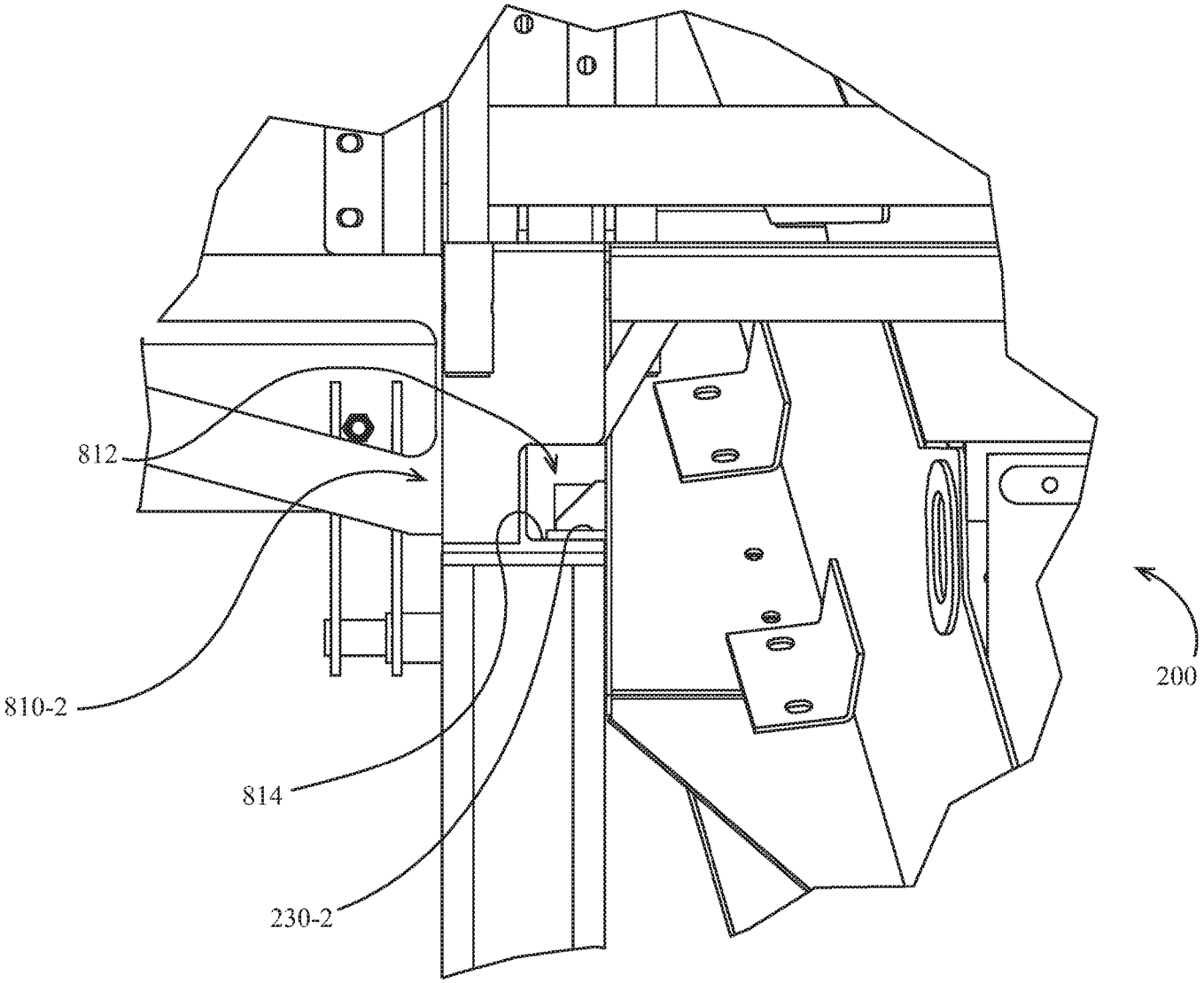
FIG. 4 is an expanded view of the detail area C of FIG. 3.

In some embodiments, a chute assembly 200 is disposed in front of the screen 120 and is optionally selectively positioned with respect to the frame or optionally removable from the frame 800, e.g., by sliding the chute assembly 200 out (e.g., to the left or right on the view of FIG. 2) from the frame 800 via one or more slots in the frame 800. The chute assembly 200 optionally includes a plurality of chutes (e.g., an upper chute 210 and lower chutes 220-1, 220-2) disposed to receive material from the screen 120. In some embodiments the screen 120 is a three-deck vibratory screen. In some embodiments, each deck of the screen 120 is aligned with one of the chutes of the chute assembly 200 such that oversize material passing over the top of each deck is transferred to an associated chute. Referring to FIG. 4, each slot 812 optionally comprises a longitudinally extending slot formed by one or more longitudinally extending members 810-1, 810-2 (e.g., beams other structure). The slots 812 in the frame 800 optionally include one or more lower surfaces 814. In some embodiments, the lower surfaces of the slots are coated with a wear-resistant and/or low-friction-material such as ultra-high-molecular-weight (UHMW) polyethelyne, rubber, plastic or another material.

Figure 5:
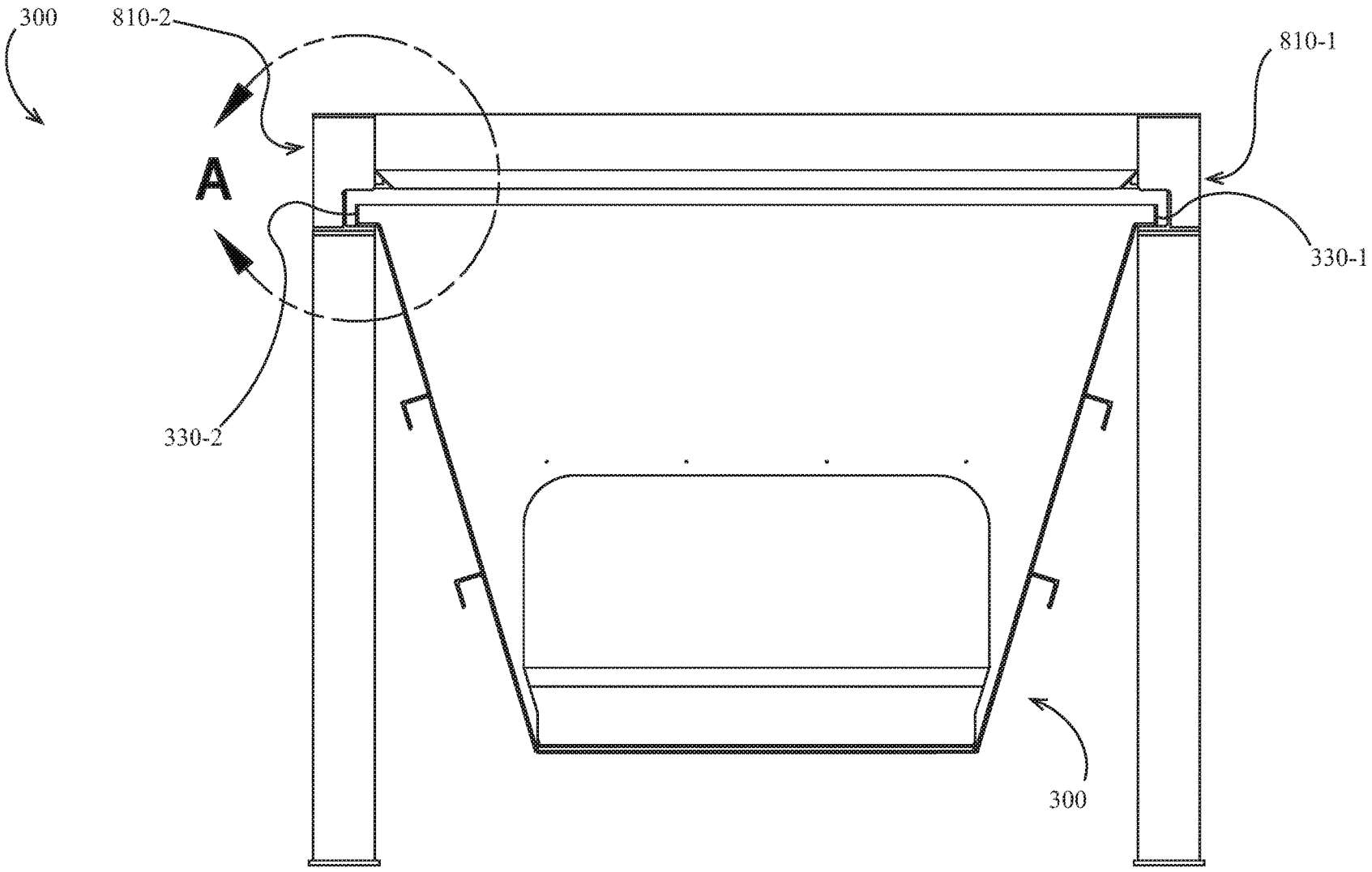
FIG. 5 is a front elevation view of an embodiment of a dry screen hopper.
Figure 6:
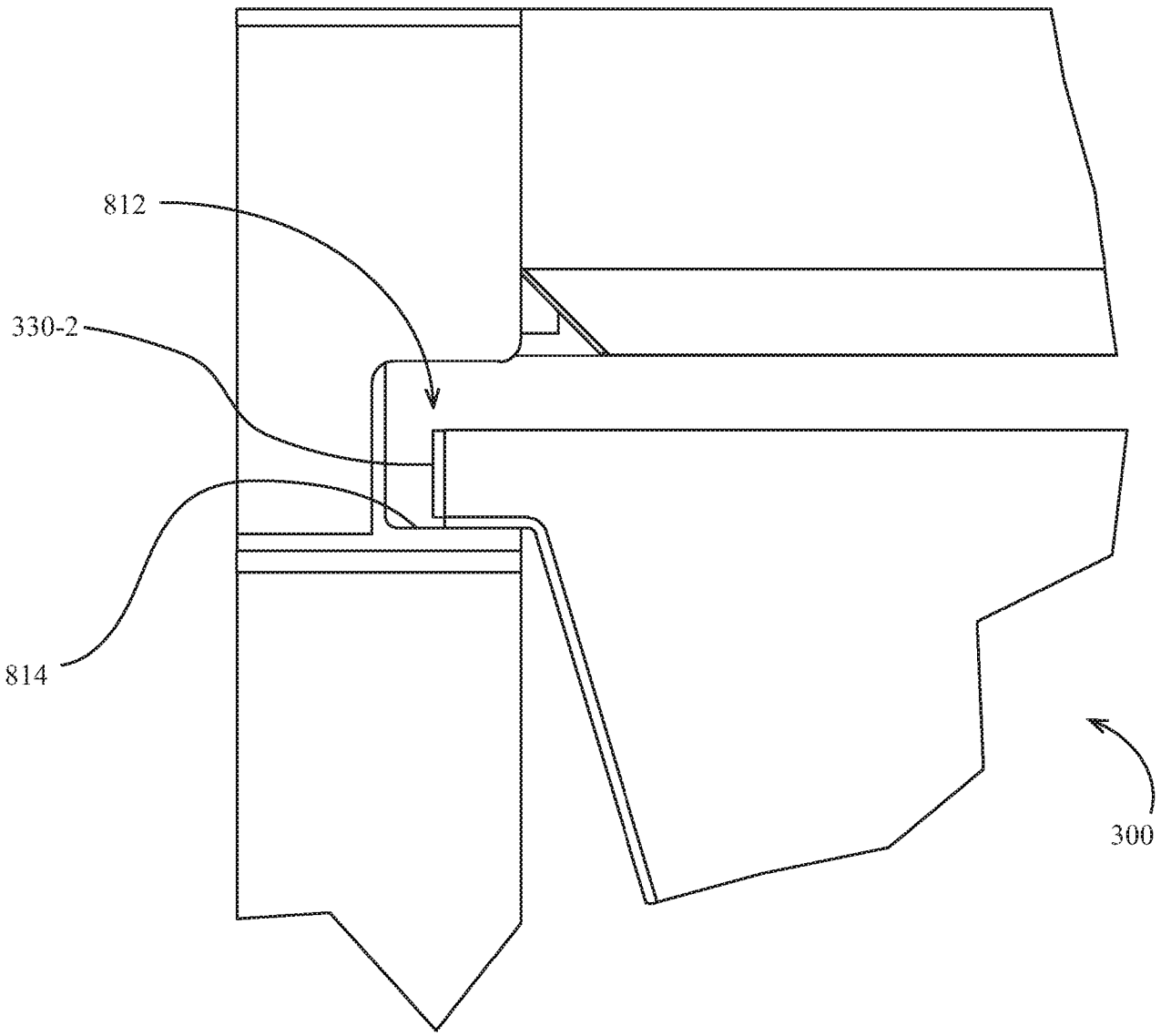
FIG. 6 is an expanded view of the detail area A of FIG. 5.
Figure 7:
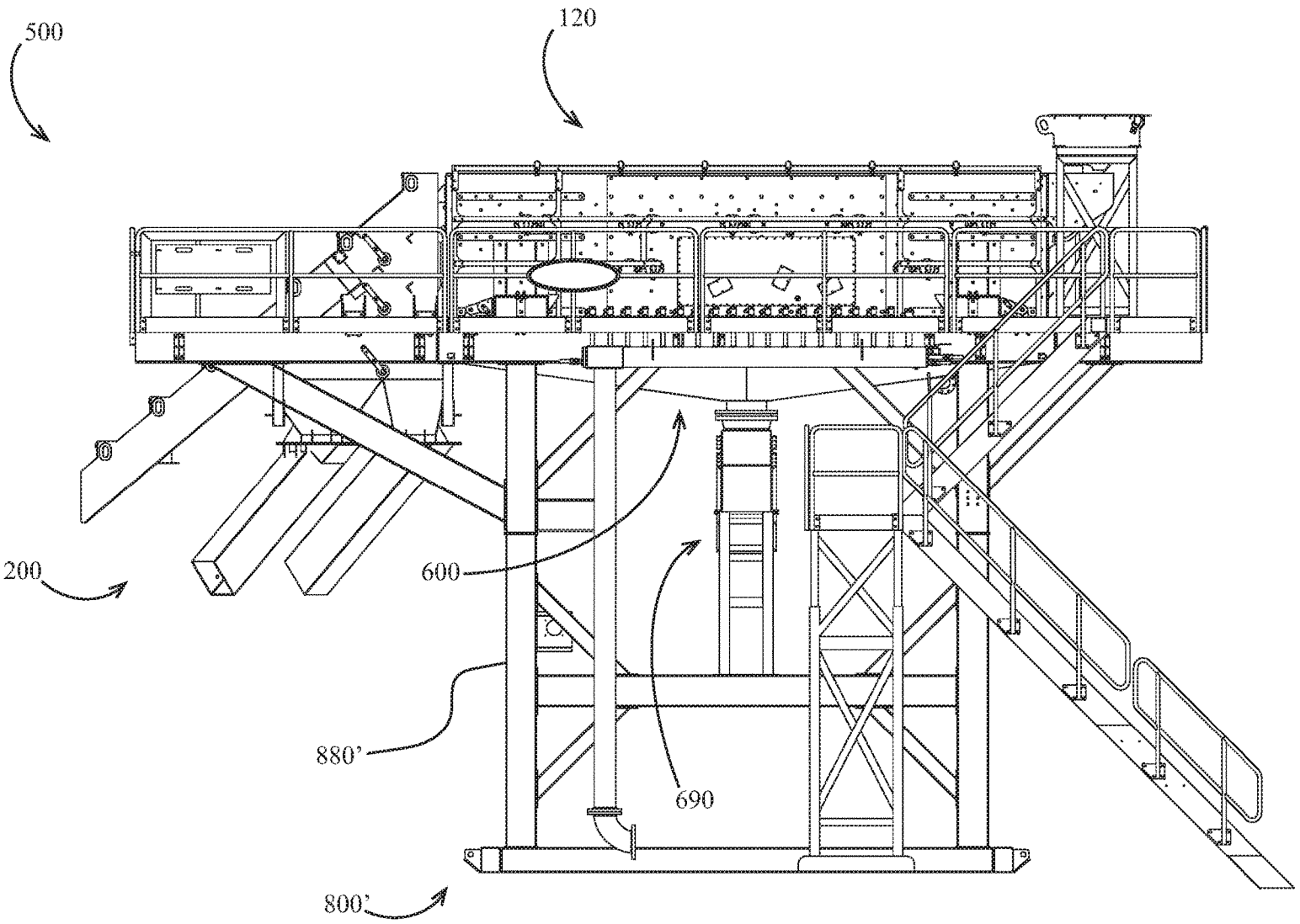
FIG. 7 is a side elevation view of an embodiment of an aggregate processing plant in a wet processing configuration.
Figure 8:
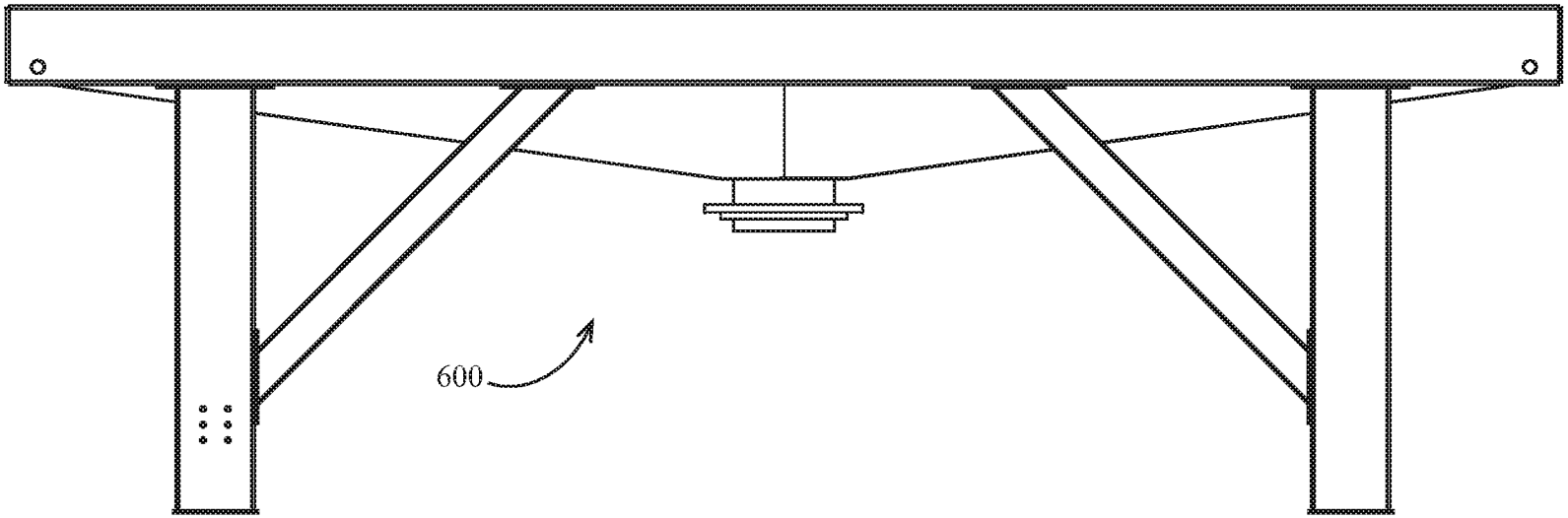
FIG. 8 is a side elevation view of an embodiment of a wet screen flume.
Figure 9:
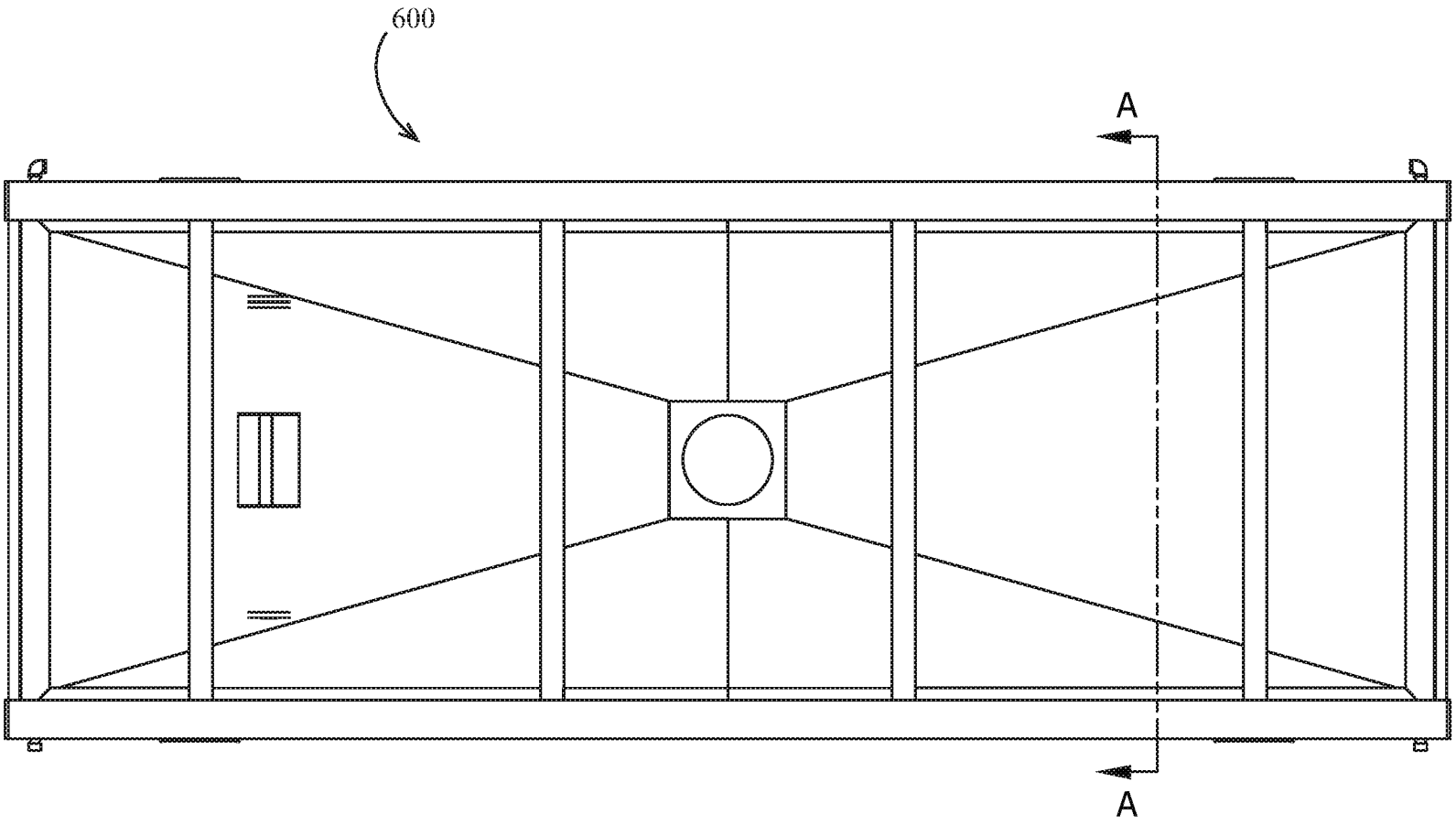
FIG. 9 is a plan view of the flume of FIG. 8.
Figure 10:
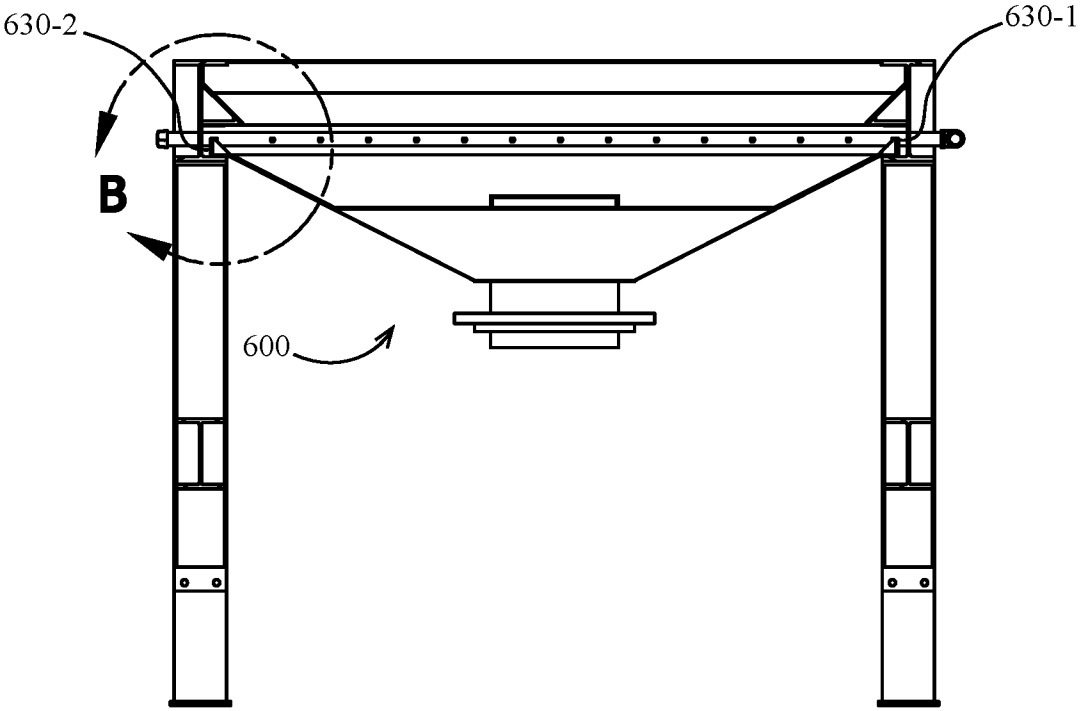
FIG. 10 illustrates section A-A of FIG. 9.
Figure 11:
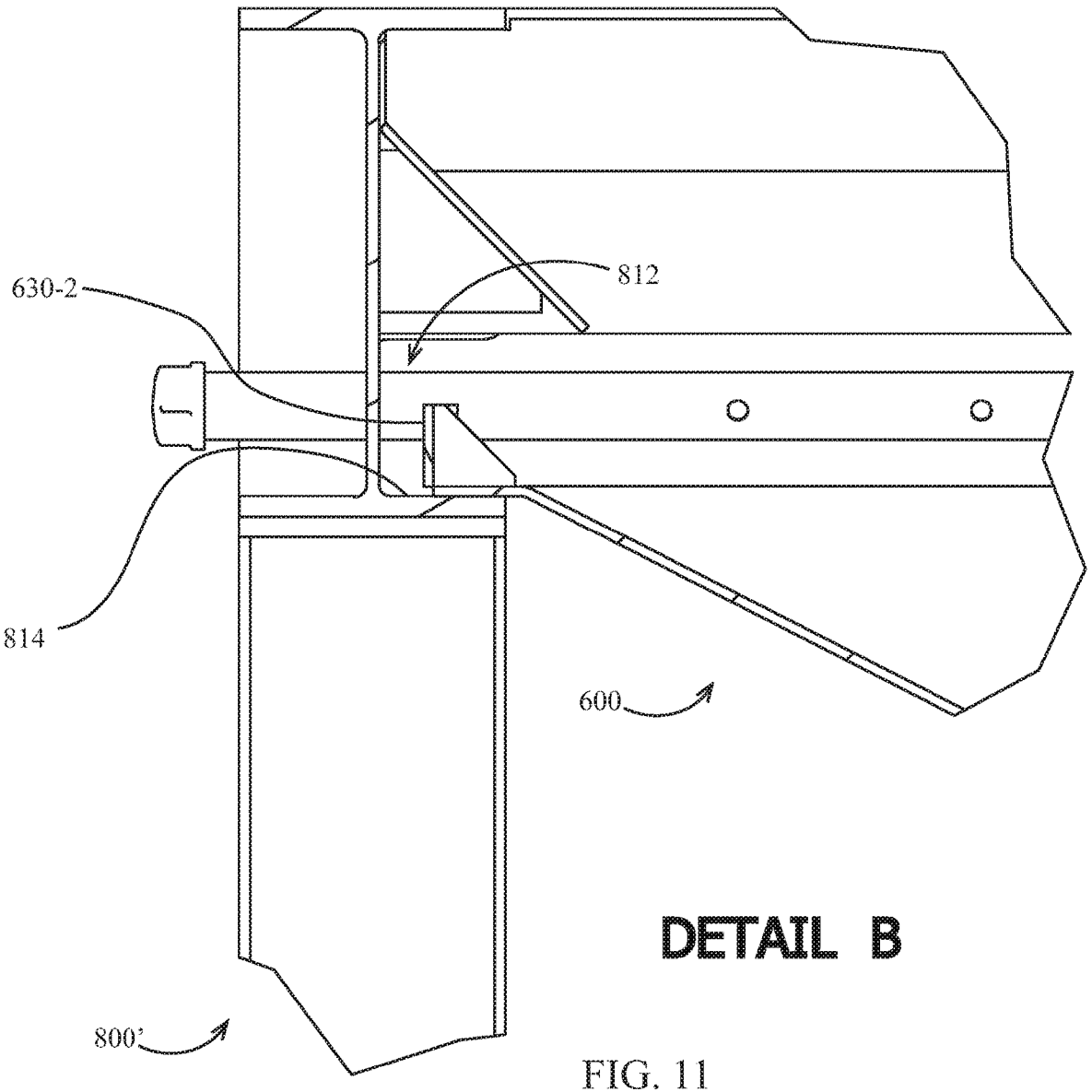
FIG. 11 illustrates detail area B of FIG. 10.
Figure 12:
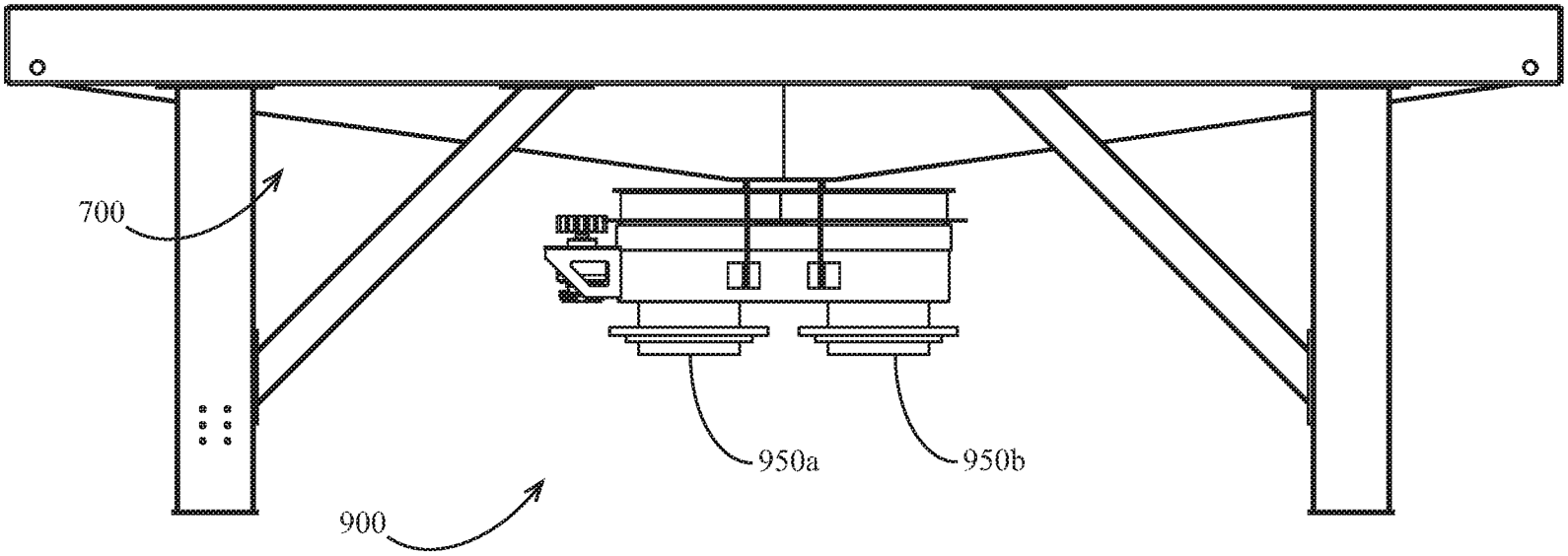
FIG. 12 is a side view of an embodiment of a split wet screen flume.
Figure 13:
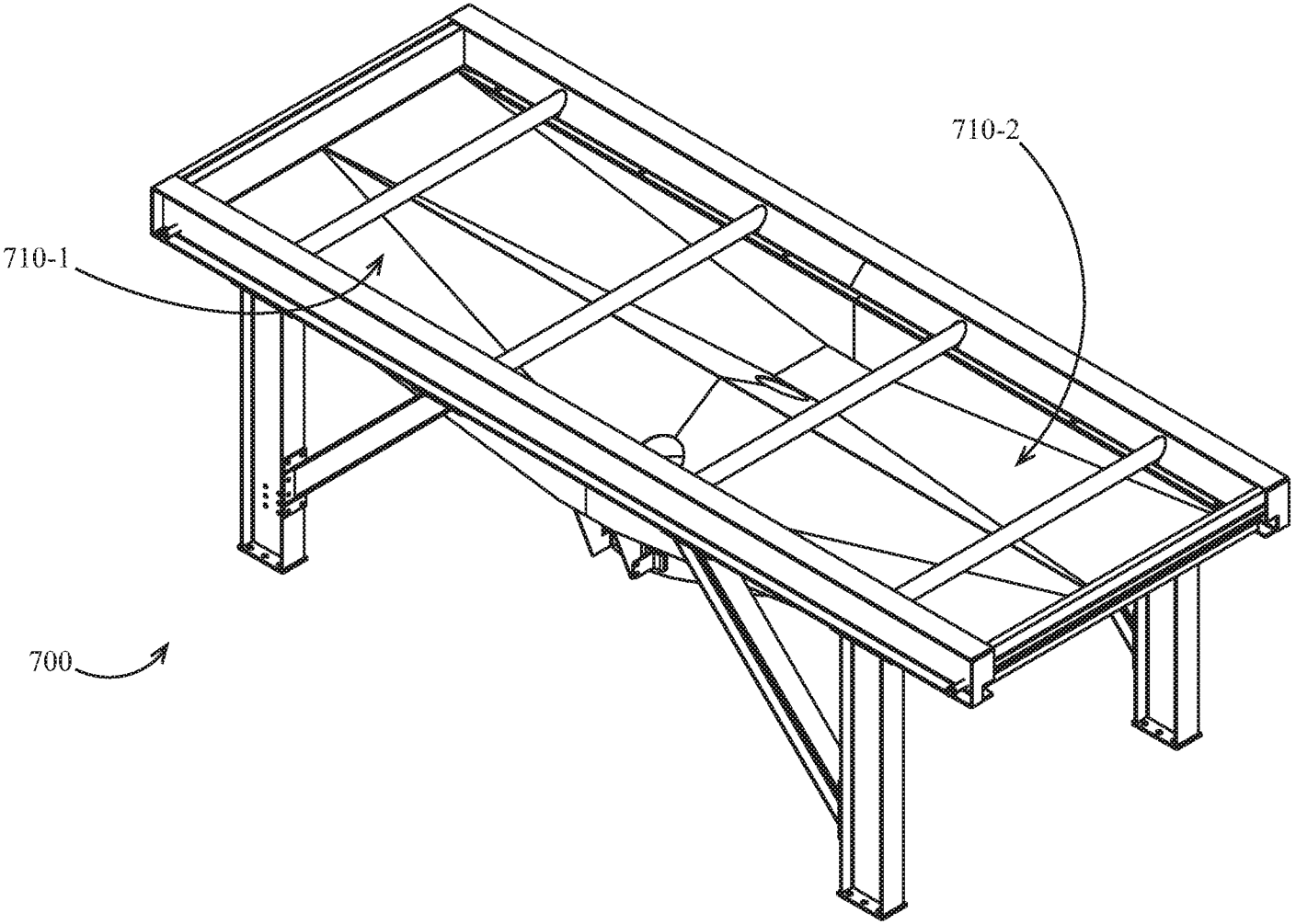
FIG. 13 is a perspective view of the flume of FIG. 12.
Figure 14:
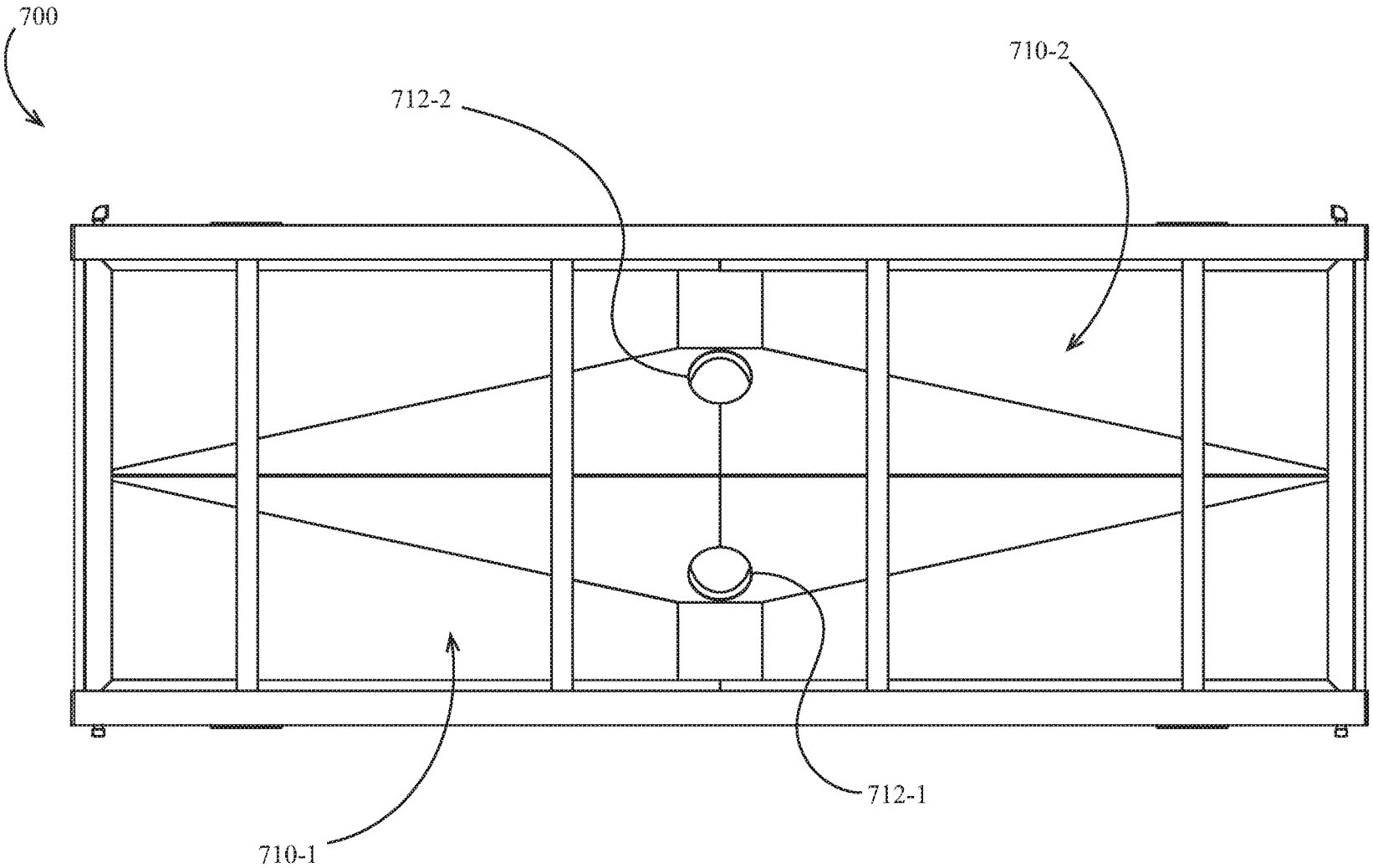
FIG. 14 is a plan view of the flume of FIG. 12.
Figure 15:
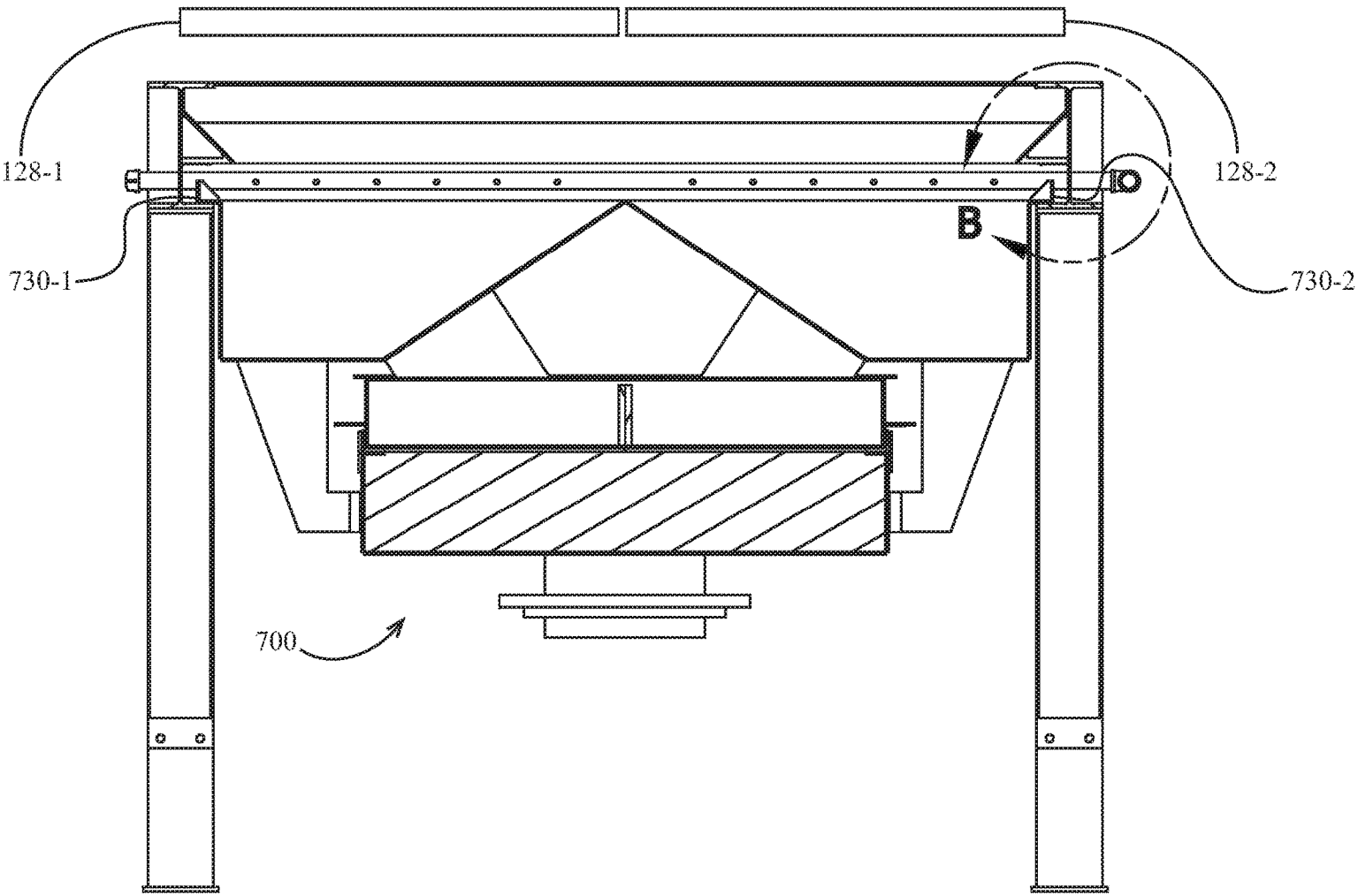
FIG. 15 illustrates section A-A of FIG. 14.
Figure 16:
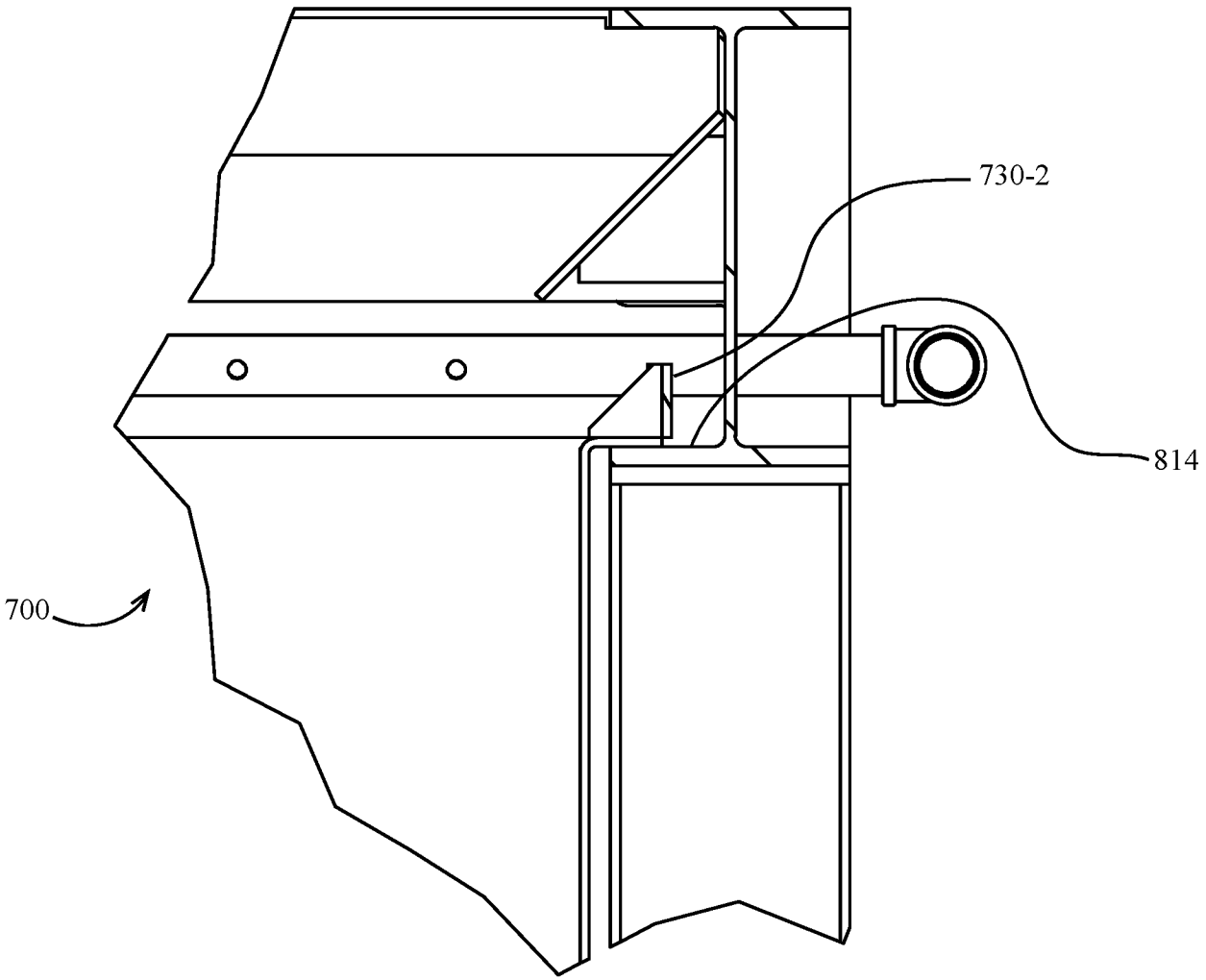
FIG. 16 illustrates detail area B of FIG. 15.

Referring to FIGS. 5 and 6, the lower surfaces 814 optionally support the dry hopper 300 in operation and/or during installation and/or or removal of the dry hopper 300. In some embodiments, laterally extending lips 330-1, 330-2 of the dry hopper 300 (or other structure mounted to or formed as a part with the dry hopper) are supported on a lower surface 814 of an associated slot 812. In some embodiments, the lips 330-1, 330-1 are moveable (e.g., slidable, etc.) relative to the lower surfaces 814. In some embodiments, the slots 812 provide clearance (e.g., vertical clearance and/or lateral clearance) for moving (e.g., sliding, etc.) the chute assembly 200 relative to the frame 800.

Referring to FIG. 4, the surfaces 814 optionally support the chute assembly 200 in operation and/or during installation and/or removal of the chute assembly 200. In some embodiments, laterally extending lips (e.g., lips 230-2) of the chute assembly 200 (or other structure mounted to or formed as a part with the chute assembly) are supported on a lower surface 814 of an associated slot 812. In some embodiments, the lips 230 are moveable (e.g., slidable, etc.) relative to the lower surfaces 814. In some embodiments, the slots 812 provide clearance (e.g., vertical clearance and/or lateral clearance) for moving (e.g., sliding, etc.) the chute assembly 200 (e.g., longitudinally) relative to the frame 800.

In some embodiments, a conveyor 190 or other device is disposed below the dry hopper 300 and configured to convey material from the dry hopper to another location.

Referring to FIGS. 7-11, the aggregate processing plant 100 is optionally reconfigurable into an aggregate processing plant 500 including the screen 120 supported on a modified frame 800', which optionally has a modified height relative to the frame 800. The height of the frame 800' may be increased or decreased by replacing a lower portion 880' (e.g., legs, skids, supports, etc.) of the frame 800. In some embodiments, wet flume 600 is disposed below the screen 120 and is optionally selectively positioned relative to the frame 800' or optionally removable from the frame 800', e.g., by sliding the wet flume 600 out (e.g., to the left or right on the view of FIG. 7) from the frame 800' via one or more slots in the frame 800'. In some embodiments, laterally extending lips 630-1, 630-2 of the wet flume 600 (or other structure mounted to or formed as a part with the wet flume) are supported on a lower surface 814 of an associated slot 812. In some embodiments, the lips 330-1, 330-2 are moveable (e.g., slidable, etc.) relative to the lower surfaces 814. In some embodiments, a chute assembly 200 is disposed in front of the screen 120 and is optionally removable from the frame 800', e.g., by sliding the chute assembly 200 out (e.g., to the left or right on the view of FIG. 7) from the frame 800' via one or more slots in the frame 800'. The slots in the frame 800' optionally include lower surfaces supporting the chute assembly 200 and/or the wet flume 600 in operation. In some embodiments, the lower surfaces of the slots are coated with a wear-resistant and/or low-friction material such as UHMW, rubber, plastic or another material. In some embodiments a chute assembly 690 is disposed below the wet flume 600 to receive material from the wet flume 600.

Referring to FIGS. 12-16, in some embodiments a split wet flume 700 can replace the wet flume 600. In some embodiments, the split wet flume includes lips 730-1, 730-2 which are optionally moveable (e.g., slidable, etc.) relative to the frame 800 (e.g., relative to lower surfaces 814 of slots 812).

In some such embodiments, the screen 120 includes one or more screen decks which are split left to right (e.g., into screen deck portions 128-1, 128-2). The screen deck portions optionally have different characteristics (e.g., mesh sizes) such that a first specification of material falls into the left side 710-1 of the split wet flume 700 and a second (e.g., different) specification of material falls right side 710-2 of the split wet flume 700. In some embodiments, the left side 710-1 has an outlet opening 712-1 and the right side 710-2 has a separate outlet opening 712-2.

Figure 17:
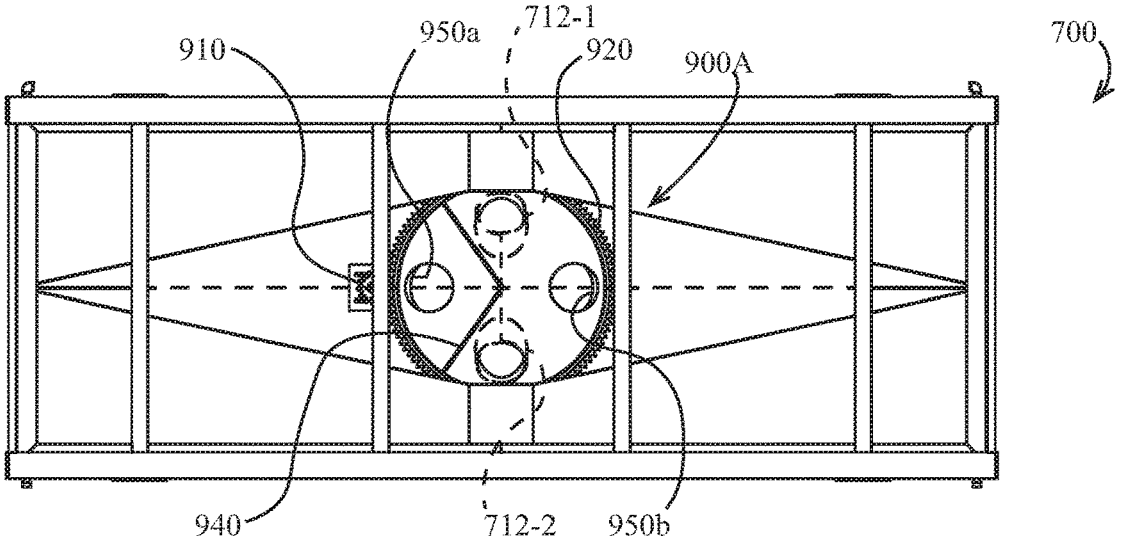
FIG. 17 is a plan view of the flume of FIG. 12 with a blending wheel assembly in a first position.
Figure 18:
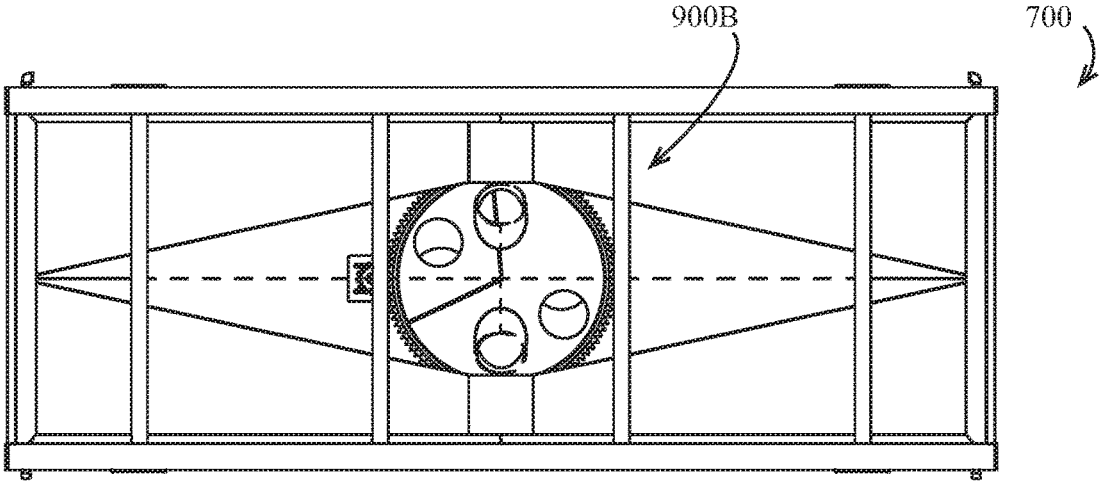
FIG. 18 is a plan view of the flume of FIG. 12 with a blending wheel assembly in a second position.
Figure 19:
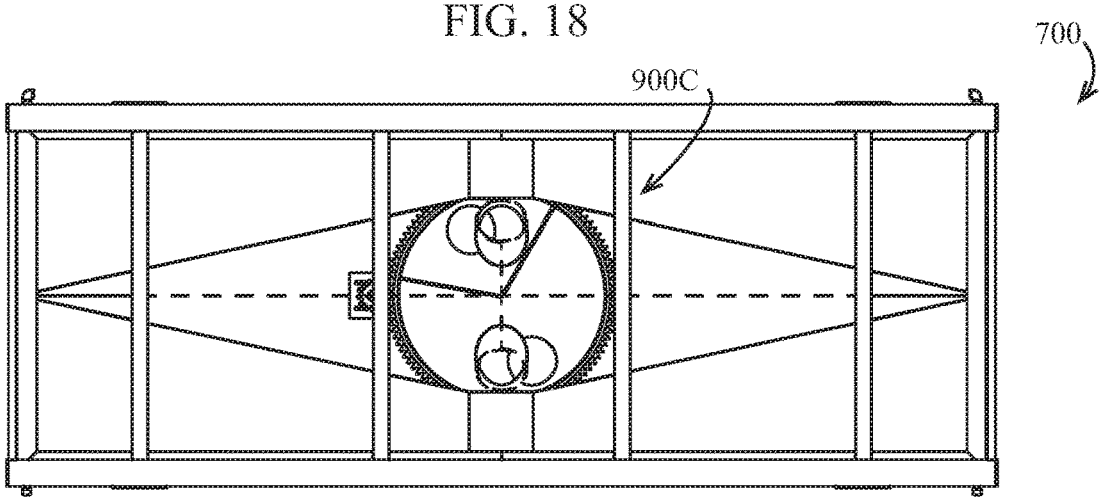
FIG. 19 is a plan view of the flume of FIG. 12 with a blending wheel assembly in a third position.

Referring to FIGS. 17-19, in some embodiments a blending assembly 900 having a plurality of outlets (e.g., 950*a*, 950*b*) is optionally disposed beneath the split wet flume 700 and configured to modify the blend of material transferred from the split flume to one or more locations. In some embodiments the blending assembly includes a blending wheel 920 having a plurality of openings and selectively turned by a gear 910. The blending assembly optionally includes one or more walls 940 (e.g., supported on or above the blending wheel) for separating the openings in the blending wheel.

For example, as illustrated in FIGS. 17-19, in a first position 900A the blending assembly 900 directs material from both outlet openings 712 to the outlet 950*b*. In a second position 900B the blending assembly 900 directs material from outlet opening 712-2 to the outlet 950*b* and directs first and second portions of material from outlet opening 712-1 to outlets 950*a* and 950*b*, respectively. In a third position 900C, the blending assembly 900 directs material from outlet opening 712-1 to outlet 950*a* and directs material from outlet opening 712-2 to outlet 950*b*.

In other embodiments, the blending assembly may include a gate or may be replaced with a gate assembly that selects an output path without blending.

It should be appreciated that various configurations of aggregate processing plants may be assembled by selectively installing (e.g., by sliding) the dry hopper 300, the flume 600, or the split wet flume 700 into the frame 800.

Figure 20:
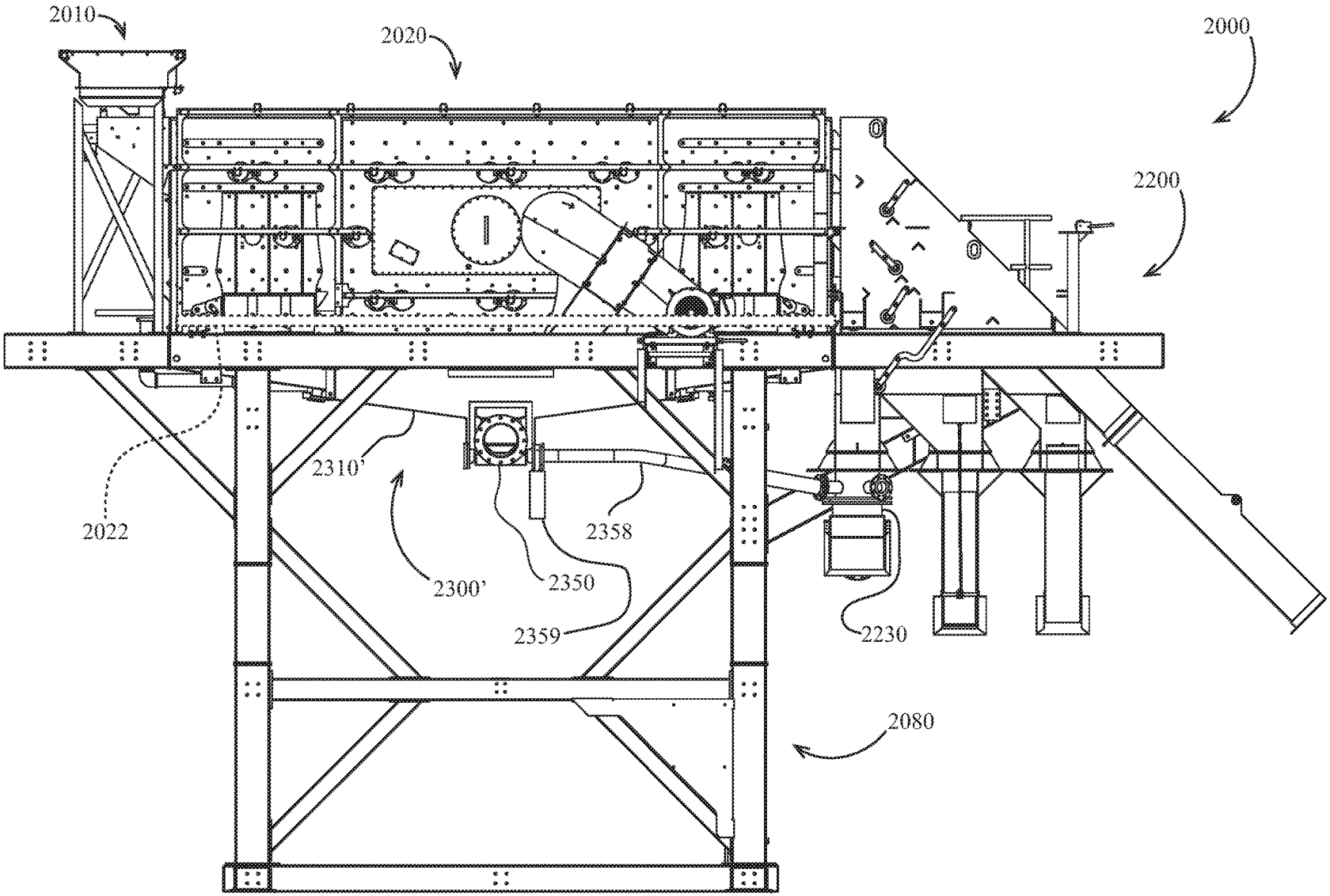
FIG. 20 is a side elevation view of another embodiment of an aggregate processing plant.
Figure 21A:
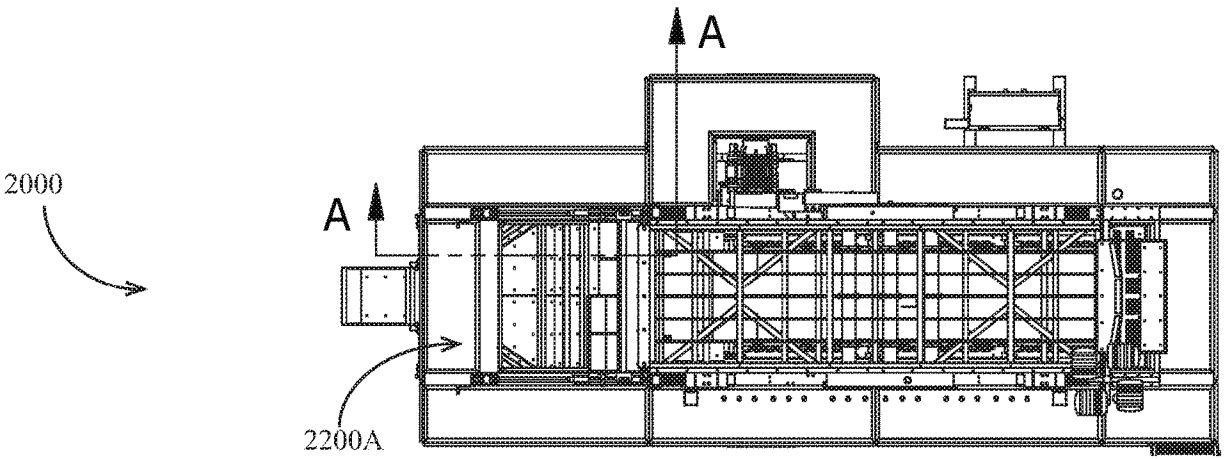
FIG. 21A is a plan view of the plant of FIG. 20 with a chute in an operational configuration.
Figure 21B:
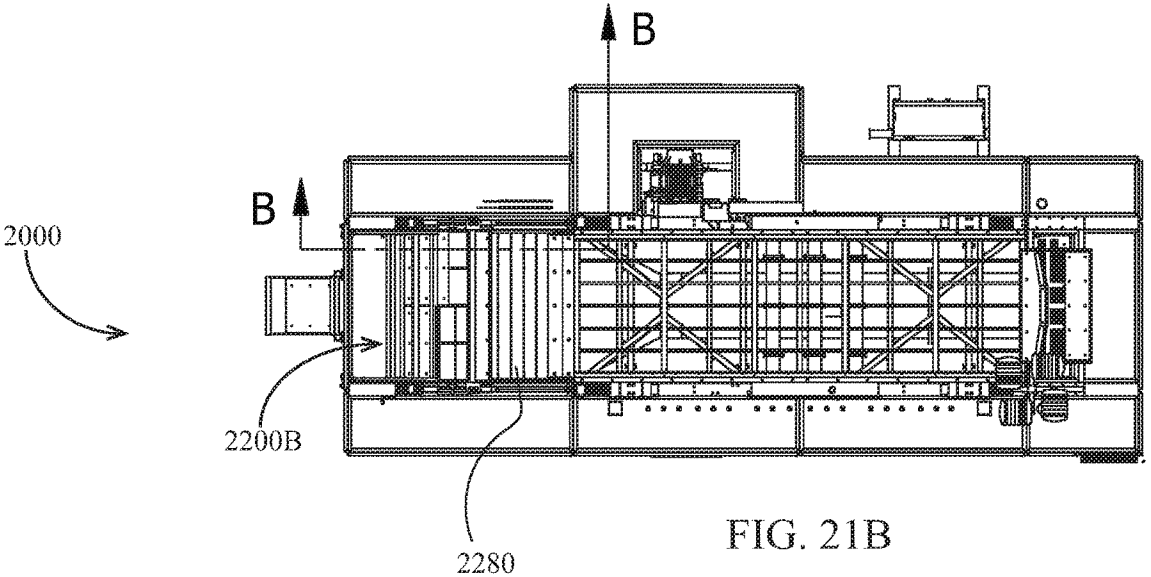
FIG. 21B is a plan view of the plant of FIG. 20 with a chute in a maintenance configuration.
Figure 22B:
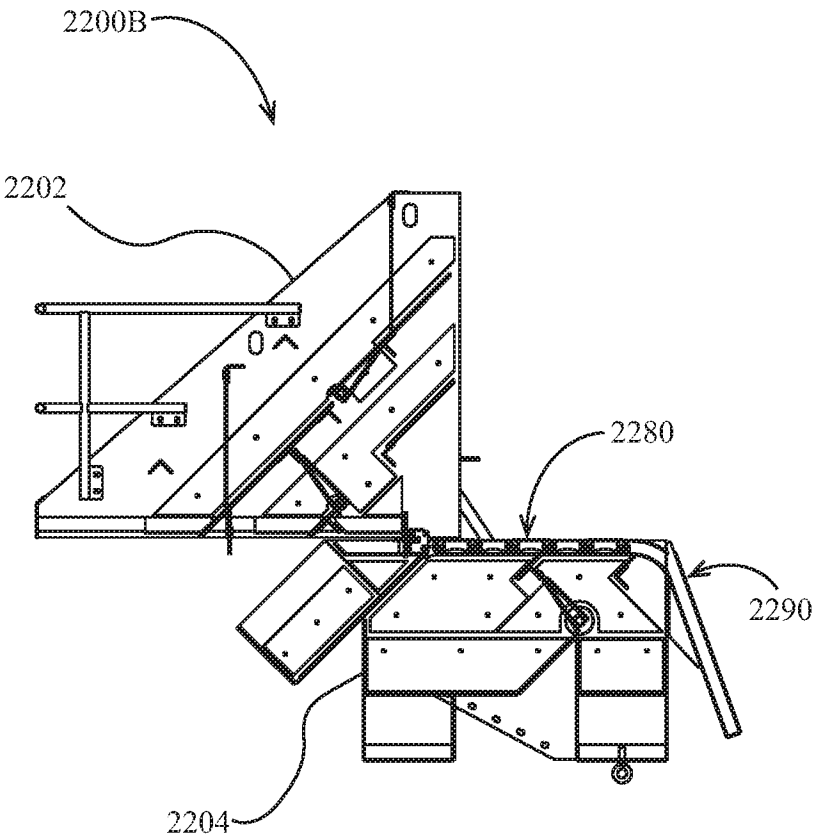
FIG. 22B is a side elevation view of the chute of FIG. 22A in a maintenance configuration.
Figure 22A:
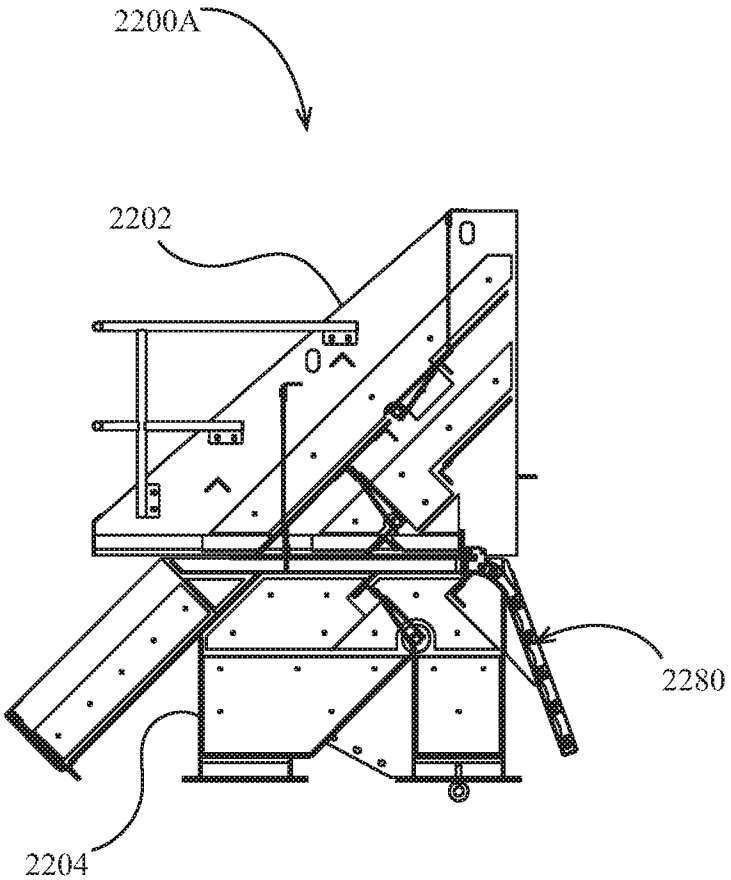
FIG. 22A is a side elevation view of an embodiment of a chute in an operational configuration.

Referring to FIG. 20, an aggregate processing plant 2000 is illustrated comprising a vibratory screen 2020 supported on a frame 2080. A hopper 2010 is optionally disposed above the screen 2020 (e.g., above a feed box or other inlet thereof). A flume embodiment (e.g., flume 2300 or flume 2300') is optionally disposed below the screen 2020 (e.g., supported on frame 2080) to receive undersize material from the screen 2020 (e.g., from a lower screen deck thereof). A chute assembly 2200 is optionally disposed forward of the screen 2020 (e.g., supported on frame 2080) to receive oversize material from the screen 2020. In some embodiments, a conduit 2358 fluidly couples an outlet 2350 of the flume 2080 to an outlet 2230 of the chute assembly 2200. In operation, a subset of material exiting flume 2300 travels through conduit 2358 to outlet 2230, while a remainder of material exiting flume 2300 exits via outlet 2350 (e.g., to another conduit, etc.). In some embodiments, a valve 2359 (e.g., knife valve, gate valve, etc.) selectively opens and closes the conduit 2358.

Referring to FIGS. 21A through 22B, in some embodiments the chute assembly 2200 has an operational configuration 2200A in which the chute assembly immediately adjacent to (and/or in contact with) a forward end of the screen 2020 in order to receive oversize material from the screen 2020, and a maintenance configuration 2200B in which the chute assembly is disposed at a forward spacing from the screen 2020 in order to allow maintenance access to the screen 2020 and/or the chute assembly 2200. In some embodiments, the chute assembly 2200 comprises an upper portion 2202 optionally comprising a plurality of inlets and a lower portion 2204 optionally comprising plurality of outlets. In some embodiments, the upper portion 2202 is slidingly engaged with the lower portion 2204 and/or the frame 2080. In some embodiments, the upper portion 2202 is disposed in a first position in the configuration 2200A and is disposed in a second position forward of the first position in the configuration 2200B.

In some embodiments, a roller floor assembly 2280 is disposed (e.g., generally horizontally) to support an operator in the configuration 2200B. In some embodiments, the roller floor assembly 2280 is attached to the chute assembly 2200 (e.g., to the upper portion 2202 thereof) and optionally moves with the chute assembly 2200 (e.g., with the upper portion 2202 thereof) as the chute assembly is reconfigured between the operational and maintenance configurations.

Figure 23:
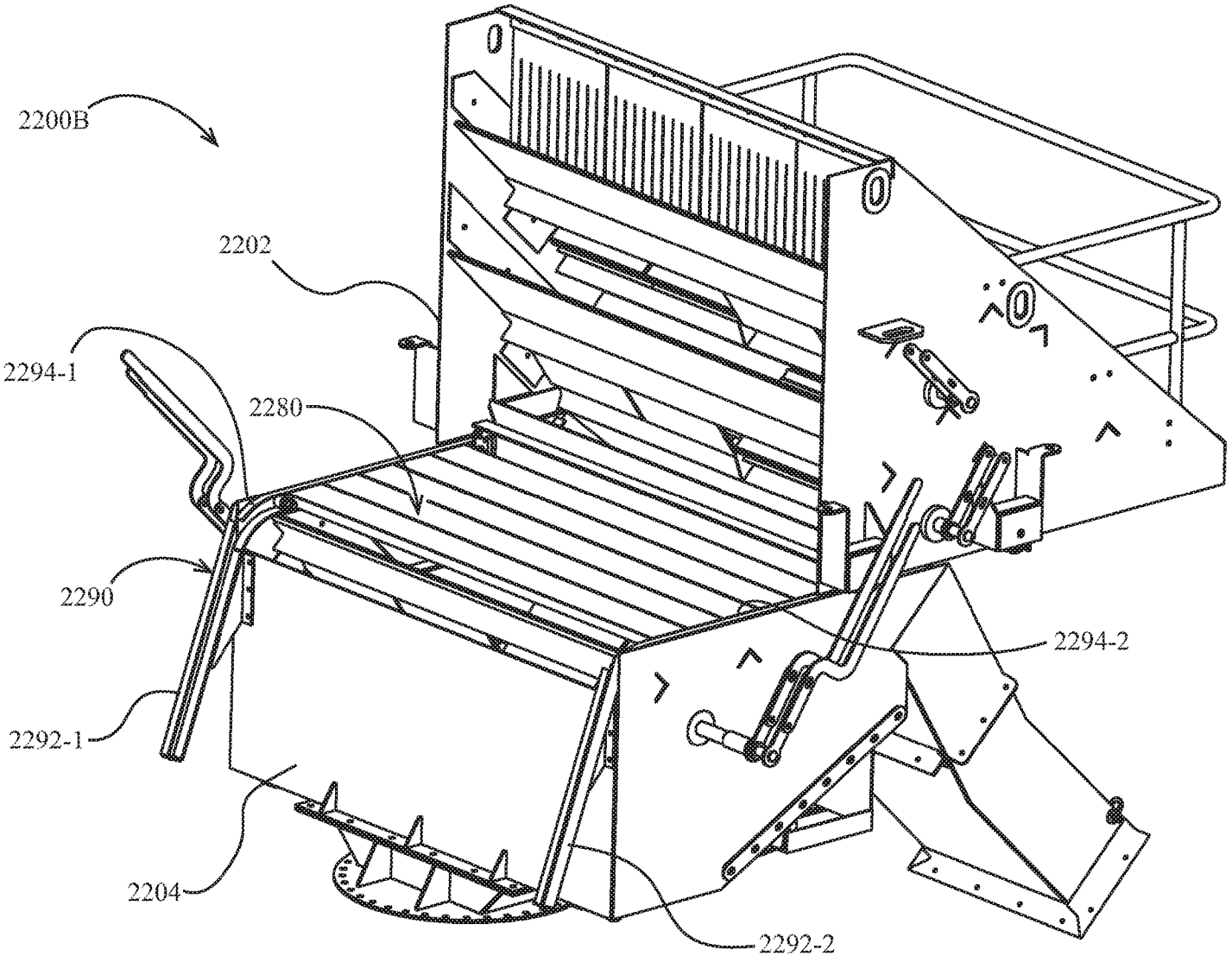
FIG. 23 is a rear perspective view of the chute of FIG. 22A.
Figure 24:
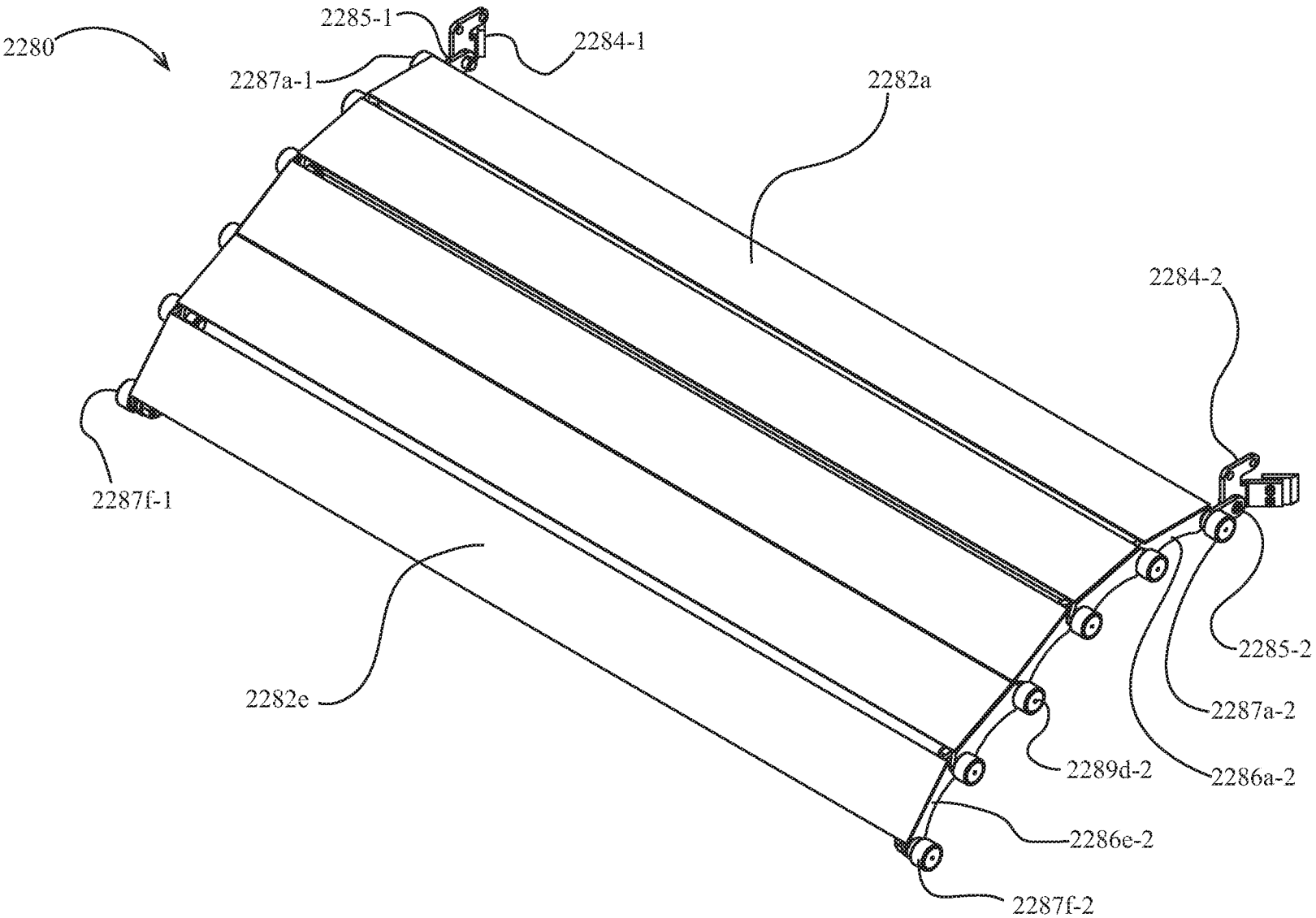
FIG. 24 is a rear perspective view of an embodiment of a roller floor.

Referring to FIGS. 23 and 24, the roller floor assembly 2280 and roller floor support assembly 2290 are illustrated in more detail. The roller floor assembly 2280 is optionally slidingly supported on the roller floor support assembly 2290. The roller floor assembly 2280 is optionally supported at a left side and right side thereof by the roller floor support assembly 2290. In some embodiments, rollers (e.g., rollers 2287*a*-1, 2287*a*-2, 2287*f*-1, 2287*f*-2) are slidingly received in channels of the roller floor support assembly 2290.

In the maintenance configuration of the chute assembly 2200, the roller floor assembly 2280 is optionally supported (e.g., in a generally horizontal orientation) by forward channels 2294-1, 2294-2 of the roller floor support assembly 2290. In the operational configuration of the chute assembly 2200, the roller floor assembly 2280 is optionally supported (e.g., in an angled orientation such as a generally downwardly extending orientation) by rearward channels 2292-1, 2292-2 of the roller floor support assembly 2290.

In some embodiments, the roller floor assembly comprises a plurality of planks (e.g., planks 2282*a*, 2282*e*) (e.g., generally laterally extending planks). In the maintenance configuration of the chute assembly 2200, the planks optionally form a platform capable of supporting an operator between the screen 2020 and chute assembly 2200, e.g., for accessing the screen 2020 or chute assembly 2200. In some embodiments, each plank is supported at a first end by a link and at a second end by a link (e.g., links 2286*a*-2, 2286*e*-2). In some embodiments, each link is pivotally coupled to one or more pivots (e.g., pivot 2289*d*-2) such that the links 2286 (and planks) are pivotable relative to one another. In some embodiments, a forward link of a first chain of links is pivotally coupled (e.g., by a forward link 2285-1) to a first bracket 2284-1 which may be mounted to a first side of the chute assembly 2200 (e.g., to the upper portion 2202 thereof). In some embodiments, a forward link 2286*a*-2 of a second chain of links is pivotally coupled (e.g., by a forward link 2285-2) to a second bracket 2284-2 which may be mounted to a second side of the chute assembly 2200 (e.g., to the upper portion 2202 thereof). In some embodiments, forward motion of the upper portion 2202 into the maintenance configuration moves (e.g., pulls) the roller floor assembly 2280 forward to form a generally horizontal platform. In some embodiments, rearward motion of the upper portion 2202 into the maintenance configuration moves the roller floor assembly 2280 into a storage position.

Figure 25:
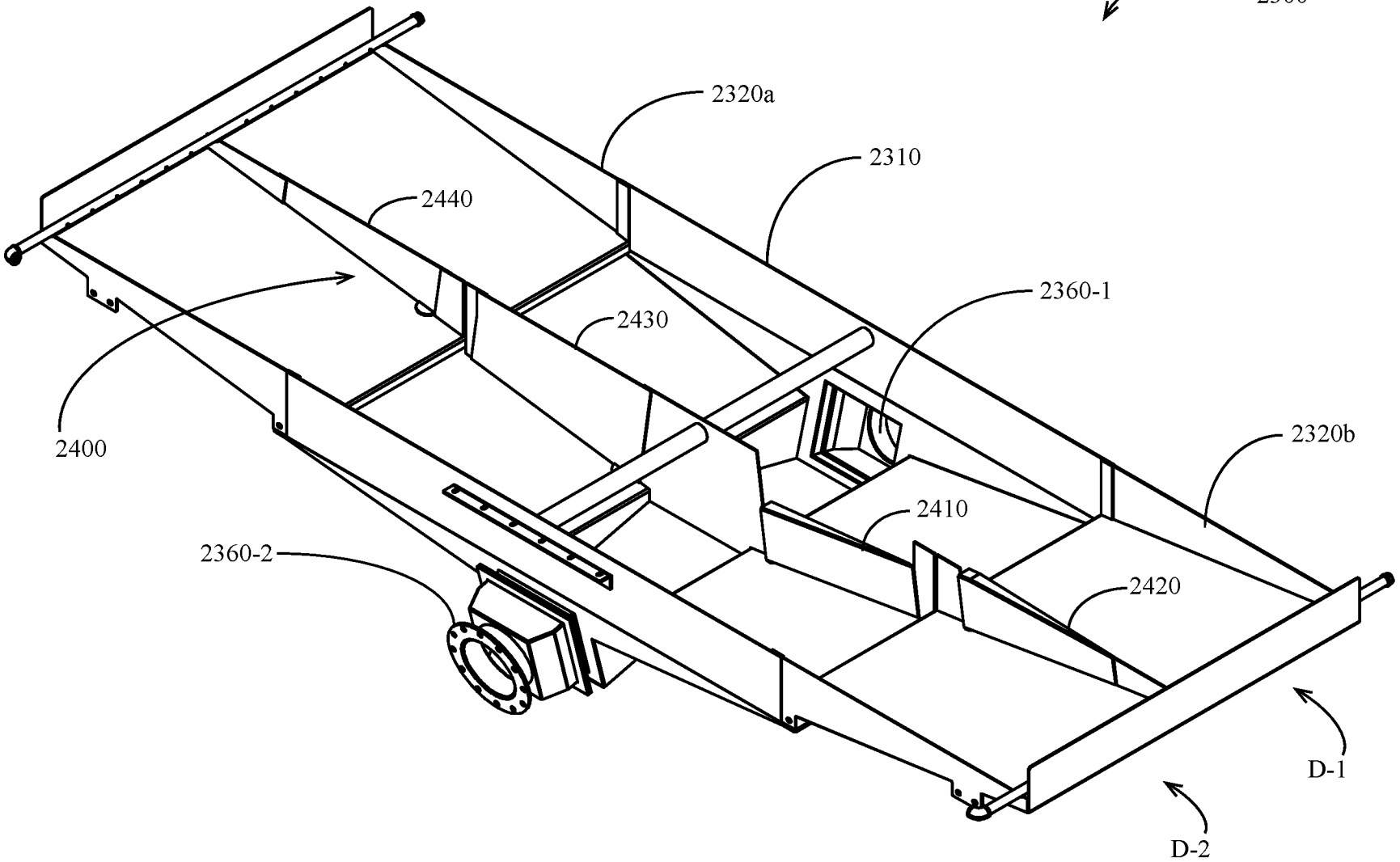
FIG. 25 is a perspective view of an embodiment of a flume.
Figure 26:
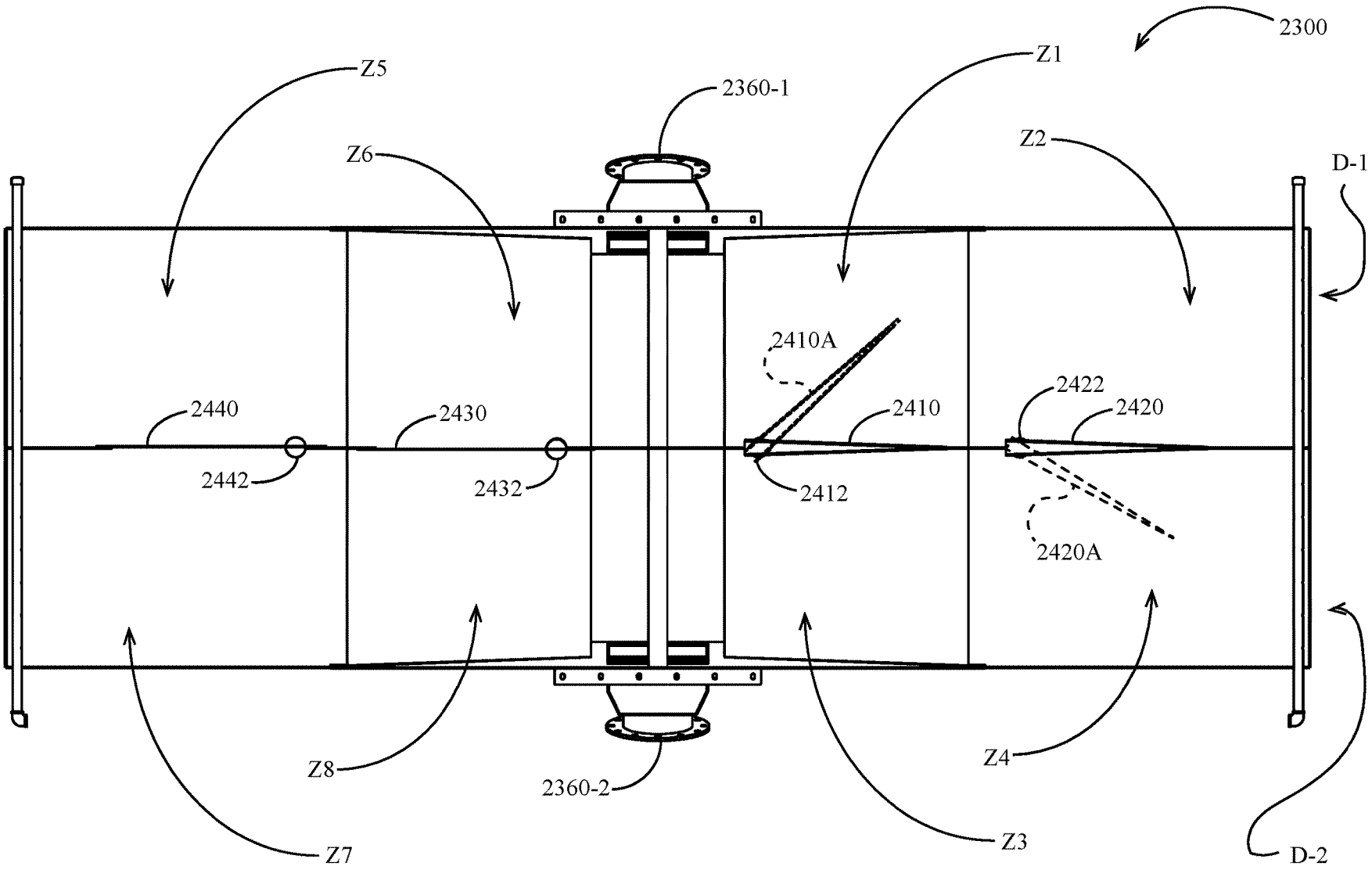
FIG. 26 is a plan view of the flume of FIG. 25.
Figure 27:
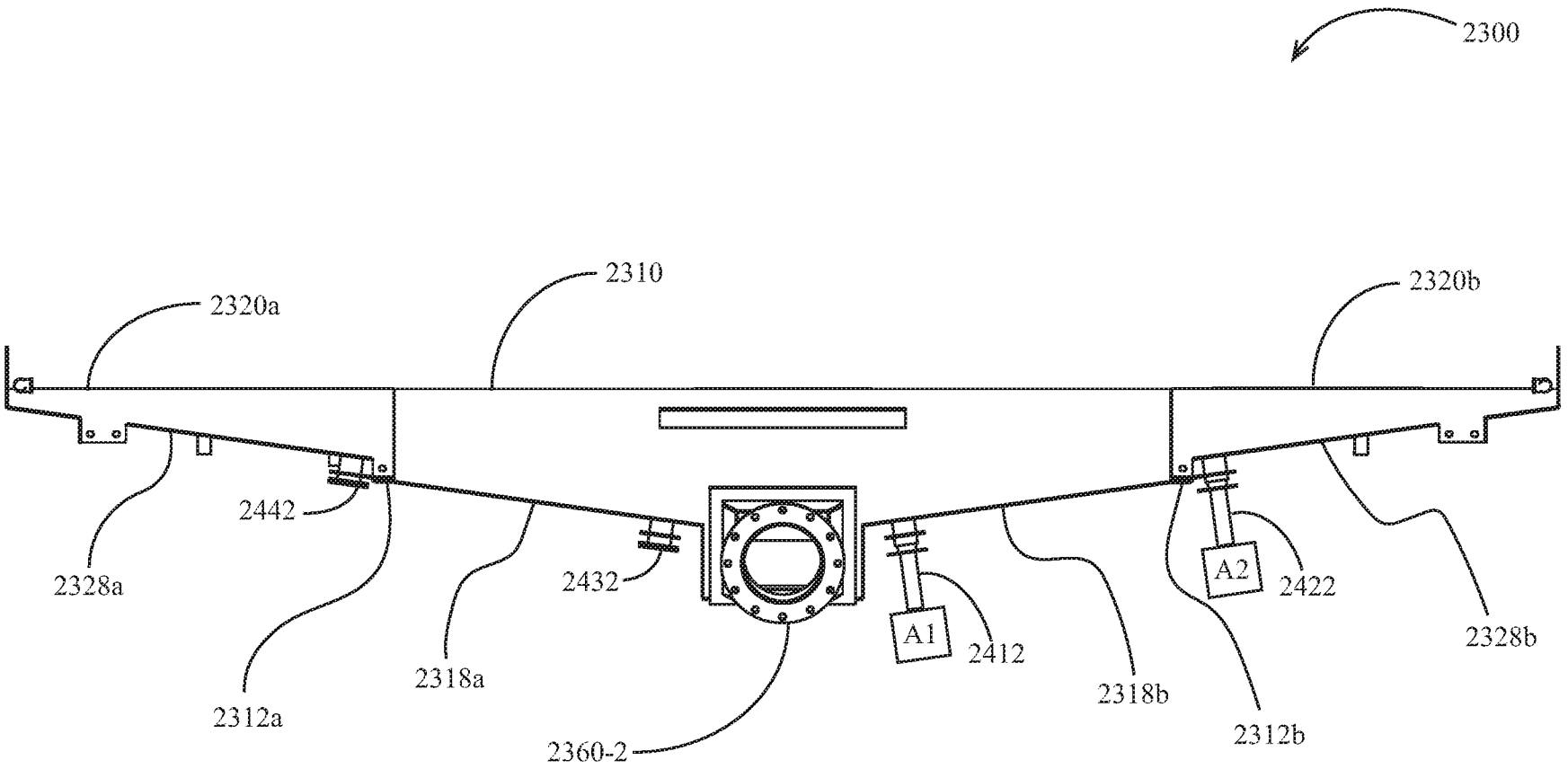
FIG. 27 is a side elevation view of the flume of FIG. 25.

Referring to FIGS. 25-27, an embodiment of a flume 2300 is illustrated optionally comprising a split flume having two outlets 2360-1, 2360-2. A first side D-1 of the flume 2300 is optionally disposed beneath a first side of a screen deck 2022 (See FIG. 20) of screen 2020. A second side D-2 of the flume 2300 is optionally disposed beneath a second side of screen deck 2022. The screen media of the first side of screen deck 2022 optionally have a different (e.g., larger or smaller) sized openings than the second side of screen deck 2022 such that a different gradation of material falls onto the first side D-1 of the flume than onto the second side D-2 of the flume. A longitudinally extending divider such as divider assembly 2400 (see FIG. 25) optionally separates (e.g., substantially separates) the sides D-1, D-2 such that material entering side D-1 exits (e.g., exclusively exists, substantially exclusively exits, etc.) outlet 2360-1 and material entering side D-2 exits (e.g., exclusively exits, substantially exclusively exits, etc.) outlet 2360-2.

Referring to FIG. 26, the flume 2300 optionally comprises a central section 2310 having slanted lower floors 2318*a*, 2318*b* for allowing material to flow to outlets 2360-1, 2360-2 by gravity. The flume optionally comprises distal sections 2320*a*, 2320*b* having slanted lower floors 2328*a*, 2328*b* respectively for allowing material to flow to the central section 2310 by gravity.

In some embodiments, the flume 2300 comprises one or more movable diverters (e.g., paddles, walls, etc.) which may be moved between a plurality of positions in order to divert a subset of material from side D-1 to side D-2 of the flume or from side D-2 to side D-1 of the flume. It should be appreciated that such diversion will tend to result in a modification of the gradation profile of material exiting the outlets 2360-1, 2360-2. In some embodiments, the diverters are movable (e.g., pivotable) between positions by one or more powered actuators A (e.g., servo motors, rotary actuators, linear actuators operably coupled to a rotary arm, etc.) such as actuators A1 and A2, which actuators may be in data communication with a controller for allowing an operator to select a position of one or more diverters in order to modify the gradation profiles. In other embodiments, the diverters are manually adjustable between various positions such as by a lever or other interface.

Referring to FIG. 26, a first diverter 2410 is optionally pivotally coupled to the flume 2300 (e.g., at a pivot 2412 such as a rod, bushing, opening or other structure) for pivoting between various positions such as the longitudinal position labeled 2410 and the diverted position labeled 2410A. It should be appreciated that in the diverted position labeled 2410A, a subset of material is diverted from side D-1 into side D-2 and therefore to outlet 2360-2. The diverter 2410 is optionally pivotable to various angles in order to divert varying amounts of material between the sides D-1 and D-2.

Referring to FIG. 26, a second diverter 2420 is optionally pivotally coupled to the flume 2300 (e.g., at a pivot 2422 such as a rod, bushing, opening or other structure) for pivoting between various positions such as the longitudinal position labeled 2420 and the diverted position labeled 2420A. It should be appreciated that in the diverted position labeled 2420A, a subset of material is diverted from side D-2 into side D-1 and therefore to outlet 2360-1. The diverter 2420 is optionally pivotable to various angles in order to divert varying amounts of material between the sides D-1 and D-2.

It should be appreciated that the number of diverters in the flume 2300 may be varied (e.g., from 0 to 1, 2, 3 or 4 or more diverters) according to various embodiments. For example, walls 2430, 2440 may each be replaced with an additional diverter which may be pivoted about pivot 2432, 2442, respectively.

Referring to FIG. 26, in various embodiments one or more diverters may be used to divert aggregate material from one or more zones Z (e.g., Z1 through Z8) of the flume 2300 to the opposite side of the flume 2300. For example, diverter 2420 is optionally pivotable in order to divert material from zone Z4 to side D-1 or to divert material from zone Z2 to side D-2. As another example, diverter 2410 is optionally pivotable in order to divert material from zone Z3 to zone side D-1 or to divert material from zone Z1 to side D-2. It should be appreciated that in addition to the optionally different amount and/or gradation of material passing through the two lateral sides of the screen deck 2022 (see FIG. 20) into sides D-1 and D-2, the amount and/or gradation of material also optionally varies longitudinally across the length of the screen deck 2022 (see FIG. 20) such that, for example, the amount and/or gradation of material falling into zone Z2 may be different than that of material falling into zone Z1. For example, as material moves along the length of the screen deck 2022 toward the outlet of the screen, the amount of undersize material falling through screen deck 2022 may increase.

Thus in some methods of operating the various embodiments described herein, the gradation of material exiting outlets 2360-1, 2360-2 may be varied by adjusting a position of one or more diverters (e.g., 2410, 2420) in order to divert material from one or more zones of the flume to the opposite side of the flume.

Figure 28:
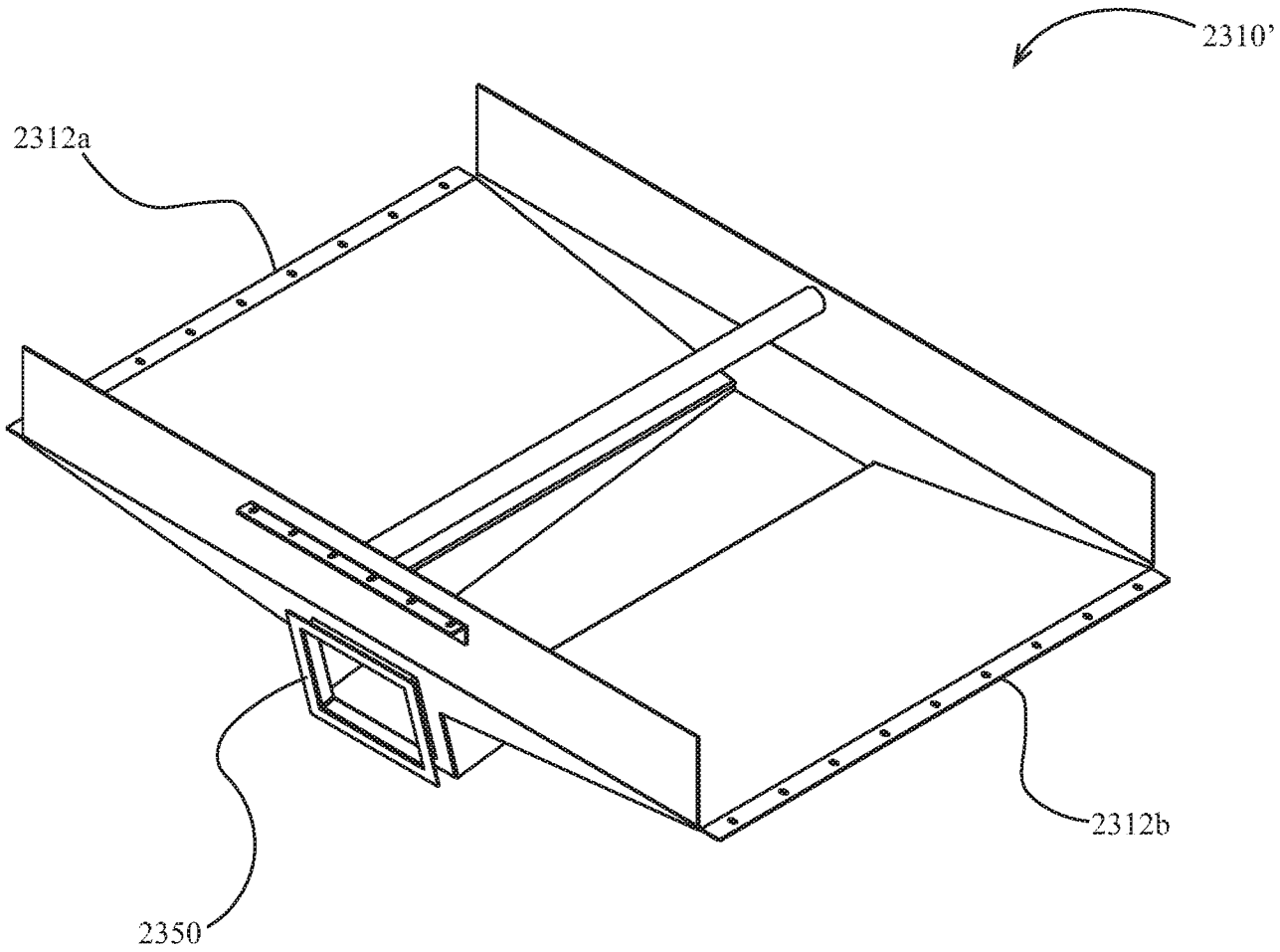
FIG. 28 is a perspective view of an embodiment of a flume center section.

Referring to FIG. 28, in some embodiments such as flume 2300', the center section may be replaced with center section 2310' which in some embodiments has a single outlet 2350. In some embodiments, the center sections 2310, 2310' are each provided with attachment lips 2312*a*, 2312*b* (e.g., lips provided with a plurality of bolt holes) or other suitable structure for removably mounting the selected center section to the distal sections 2320*a*, 2320*b* respectively.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. An aggregate processing plant, comprising:

a vibratory screen comprising at least a first screen deck, said first screen deck comprising a first deck portion and a second deck portion, said first deck portion having a different screening characteristic than said second deck portion; and a flume disposed to receive undersize material from said vibratory screen, said flume having a first side and a second side, said first side disposed at least partly beneath said first deck portion, said second side disposed at least partly beneath said second deck portion, said flume having a lower surface disposed between said first side and said second side, said flume having at least a first diverter, said first diverter repositionable from a first position to a second position about a diverter axis, wherein in said second position of said first diverter, a subset of undersize material entering said flume is diverted from said first side to said second side, said first diverter having a lower edge extending along said lower surface of said flume, said lower edge extending along said lower surface away from said diverter axis from a first end proximal to said diverter axis to a second end distal from said diverter axis, wherein a height of said first diverter decreases from the first end to the second end along a direction normal to said diverter axis, wherein said height is measured from said lower surface of said flume to an upper edge of said first diverter.

2. The aggregate processing plant of claim 1, wherein said flume includes at least a first actuator, said first actuator being operably coupled to said first diverter.

3. The aggregate processing plant of claim 2, wherein actuation of said first actuator rotates said first diverter about the diverter axis between said first position and said second position.

4. The aggregate processing plant of claim 2, wherein said flume further comprises a second diverter.

5. The aggregate processing plant of claim 4, wherein said flume further comprises a second actuator, said second actuator being operably coupled to said second diverter.

6. The aggregate processing plant of claim 5, further comprising a controller in data communication with said first and second actuators for controlling a position of said first and second diverters.

7. The aggregate processing plant of claim 2, further comprising a controller in data communication with said first actuator for controlling a position of said first diverter.

8. The aggregate processing plant of claim 1, wherein said first diverter is part of a longitudinally extending divider, wherein in said first position said longitudinally extending divider is positioned to separate said first side from said second side.

9. The aggregate processing plant of claim 1, further comprising:

at least a first discharge chute disposed forward of said vibratory screen, said first discharge chute disposed to receive oversized material from said vibratory screen.

10. The aggregate processing plant of claim 9, further comprising:

a conduit, said conduit fluidly coupling said flume to said first discharge chute.

11. The aggregate processing plant of claim 9, wherein said first discharge chute has an operational configuration and a maintenance configuration, the aggregate processing plant further comprising:

a roller floor assembly operably coupled to said first discharge chute, wherein said roller floor assembly is generally horizontal in said maintenance configuration, and wherein said roller floor assembly is stored in a non-horizontal arrangement in said operational configuration.

12. The aggregate processing plant of claim 1, wherein said flume is removable, and further comprising a hopper, wherein said hopper is configured to be installed in place of said flume.

13. An aggregate processing plant, comprising:

a vibratory screen comprising at least a first screen deck, said first screen deck comprising a first deck portion and a second deck portion, said first deck portion having a different screening characteristic than said second deck portion;

a flume disposed to receive undersize material from said vibratory screen;

at least a first discharge chute disposed forward of said vibratory screen, said first discharge chute disposed to receive oversized material from said vibratory screen, wherein said first discharge chute has an operational configuration and a maintenance configuration;

a roller floor assembly operably coupled to said first discharge chute, wherein said roller floor assembly is generally horizontal in said maintenance configuration, and wherein said roller floor assembly is stored in a non-horizontal arrangement in said operational configuration; and a pipe, said pipe directly fluidly coupling said flume to said first discharge chute.

14. The aggregate processing plant of claim 13, wherein said flume comprises a first side and a second side, wherein said flume comprises at least a first diverter, said first diverter being repositionable from a first position to a second position, wherein in said second position of said first diverter, a subset of undersize material entering said flume is diverted from said first side to said second side.

15. The aggregate processing plant of claim 13, wherein said flume comprises at least a first diverter, said first diverter being repositionable from a first position to a second position, wherein in said second position of said first diverter, a subset of undersize material entering said flume is diverted from a first zone of said flume to a second zone of said flume.

16. An aggregate processing plant, comprising:

a vibratory screen comprising at least a first screen deck and a second screen deck, said first screen deck having a different screening characteristic than said second screen deck;

at least a first discharge chute disposed at least partly forward of said vibratory screen, wherein said first discharge chute has an operational configuration and a maintenance configuration; and a roller floor assembly operably coupled to said first discharge chute, wherein said roller floor assembly extends horizontally along a first horizontal length in said maintenance configuration, and wherein said roller floor assembly is stored in a non-horizontal arrangement along a second horizontal length in said operational configuration, said second horizontal length being smaller than said first horizontal length, wherein said roller floor assembly is stored at least partly beneath said vibratory screen.

17. The aggregate processing plant of claim 16, further comprising:

a roller floor support assembly comprising a pair of channels, wherein said roller floor assembly is rollingly supported on said pair of channels.

18. The aggregate processing plant of claim 17, further comprising:

a second discharge chute, wherein said roller floor support assembly is mounted to said second discharge chute, wherein said first discharge chute is slidingly supported on said second discharge chute.

* * * * *